US008502128B1

(12) United States Patent
Streuber et al.

(10) Patent No.: US 8,502,128 B1
(45) Date of Patent: Aug. 6, 2013

(54) DUAL-MODE ELECTRO-OPTIC SENSOR AND METHOD OF USING TARGET DESIGNATION AS A GUIDE STAR FOR WAVEFRONT ERROR ESTIMATION

(75) Inventors: Casey T. Streuber, Tucson, AZ (US); Kent P. Pflibsen, Tucson, AZ (US); Michael P. Easton, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 13/621,047

(22) Filed: Sep. 15, 2012

(51) Int. Cl.

| | |
|---|---|
| ***F41G 7/20*** | (2006.01) |
| ***F42B 15/01*** | (2006.01) |
| *F41G 7/00* | (2006.01) |
| *F42B 15/00* | (2006.01) |

(52) U.S. Cl.
USPC ..... 244/3.16; 244/3.1; 244/3.15; 244/3.17

(58) Field of Classification Search
USPC ..... 244/3.1–3.19; 89/1.11; 250/200, 250/201.1, 201.9, 203.1, 203.3, 203.6, 336.1, 250/338.1, 340, 342, 353; 342/52–54; 356/3, 356/4.01; 343/700 R, 720, 721, 725, 907, 343/909, 911 R
See application file for complete search history.

(56) References Cited

U.S. PATENT DOCUMENTS

| | | | | | |
|---|---|---|---|---|---|
| 3,165,749 | A | * | 1/1965 | Cushner | 343/911 R |
| 3,971,939 | A | * | 7/1976 | Andressen | 244/3.16 |
| 4,085,910 | A | * | 4/1978 | Baker et al. | 244/3.16 |
| 4,108,400 | A | * | 8/1978 | Groutage et al. | 244/3.15 |
| 4,264,907 | A | * | 4/1981 | Durand et al. | 342/53 |
| 4,477,814 | A | * | 10/1984 | Brumbaugh et al. | 343/725 |
| 4,866,454 | A | * | 9/1989 | Droessler et al. | 343/725 |
| 5,161,051 | A | * | 11/1992 | Whitney et al. | 244/3.16 |
| 5,182,564 | A | * | 1/1993 | Burkett et al. | 342/53 |
| 5,214,438 | A | * | 5/1993 | Brusgard et al. | 343/725 |
| 5,268,680 | A | * | 12/1993 | Zantos | 342/53 |
| 5,307,077 | A | * | 4/1994 | Branigan et al. | 343/720 |
| 5,308,984 | A | * | 5/1994 | Slawsby et al. | 250/342 |
| 5,350,911 | A | * | 9/1994 | Rafanelli et al. | 250/201.9 |
| 5,368,254 | A | * | 11/1994 | Wickholm | 244/3.16 |
| 5,944,281 | A | * | 8/1999 | Pittman et al. | 244/3.12 |
| 5,973,649 | A | * | 10/1999 | Andressen | 343/720 |
| 6,021,975 | A | * | 2/2000 | Livingston | 244/3.11 |

(Continued)

OTHER PUBLICATIONS

Barrett et al, "Maximum-likelihood methods in wavefront sensing: stochastic models and likelihood functions," 2007 Optical Society of America, J. Opt. Soc. Am. A/vol. 24, No. 2/Feb. 2007, pp, 391-414.

(Continued)

*Primary Examiner* — Bernarr Gregory
(74) *Attorney, Agent, or Firm* — Eric A. Gifford

(57) ABSTRACT

A dual-mode sensor uses the active guidance radiation as a "guide star" to generate a wavefront error estimate for the primary optical element in-situ without interfering with the generation of either the active guidance or passive imaging guidance signals. An array of optical focusing elements performs the normal function of spatially encoding an angle of incidence of the active guidance radiation at an entrance pupil onto an active imaging detector. The array also performs an additional function of spatially encoding wavefront tilt deviations emanating from sub-pupils of an exit pupil onto the active imaging detector. A processor processes the electrical signals from the imaging detector in accordance with the respective spatial encodings to generate an active guidance signal and the wavefront error estimate for the primary optical element.

23 Claims, 13 Drawing Sheets

U.S. PATENT DOCUMENTS

| | | | | |
|---|---|---|---|---|
| 6,111,241 | A * | 8/2000 | English et al. | 356/4.01 |
| 6,196,497 | B1 * | 3/2001 | Lankes et al. | 244/3.17 |
| 6,262,800 | B1 * | 7/2001 | Minor | 244/3.16 |
| 6,268,822 | B1 * | 7/2001 | Sanders et al. | 342/54 |
| 6,606,066 | B1 * | 8/2003 | Fawcett et al. | 343/725 |
| 6,741,341 | B2 * | 5/2004 | DeFlumere | 356/4.01 |
| 6,924,772 | B2 * | 8/2005 | Kiernan et al. | 343/725 |
| 6,987,256 | B2 * | 1/2006 | English et al. | 250/203.6 |
| 7,049,597 | B2 * | 5/2006 | Bodkin | 250/353 |
| 7,183,966 | B1 * | 2/2007 | Schramek et al. | 244/3.16 |
| 7,504,993 | B2 * | 3/2009 | Young et al. | 342/52 |
| 7,575,191 | B2 * | 8/2009 | Layton | 244/3.16 |
| 7,786,418 | B2 * | 8/2010 | Taylor et al. | 244/3.16 |
| 8,164,037 | B2 * | 4/2012 | Jenkins et al. | 244/3.16 |
| 8,188,411 | B2 * | 5/2012 | McCarthy | 244/3.16 |
| 8,259,291 | B2 * | 9/2012 | Taylor et al. | 356/4.01 |

OTHER PUBLICATIONS

Primmerman et al., "Compensation of atmospheric optical distortion using a synthetic beacon," Nature, vol. 353, Sep. 12, 1991, pp. 141-143.

* cited by examiner $$\Delta W_x\left(XAP_i, YAP_j\right) \propto \frac{\sum_{k=1}^{N}\sum_{m=1}^{N} XLENS_{k,m} \cdot Signal\left(XAP_i, YAP_j, XLENS_k, YLENS_m\right)}{\sum_{k=1}^{N}\sum_{m=1}^{N} Signal\left(XAP_i, YAP_j, XLENS_k, YLENS_m\right)}$$

$$\Delta W_y\left(XAP_i, YAP_j\right) \propto \frac{\sum_{k=1}^{N}\sum_{m=1}^{N} YLENS_{k,m} \cdot Signal\left(XAP_i, YAP_j, XLENS_k, YLENS_m\right)}{\sum_{k=1}^{N}\sum_{m=1}^{N} Signal\left(XAP_i, YAP_j, XLENS_k, YLENS_m\right)}$$

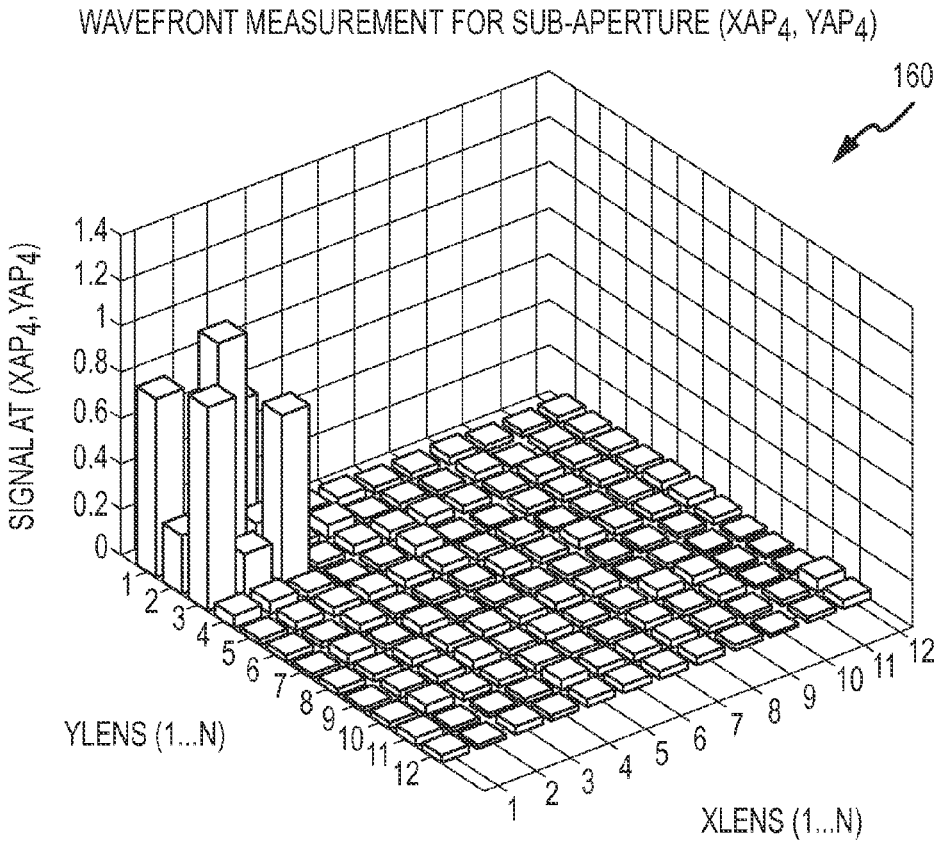

Figure 3A:
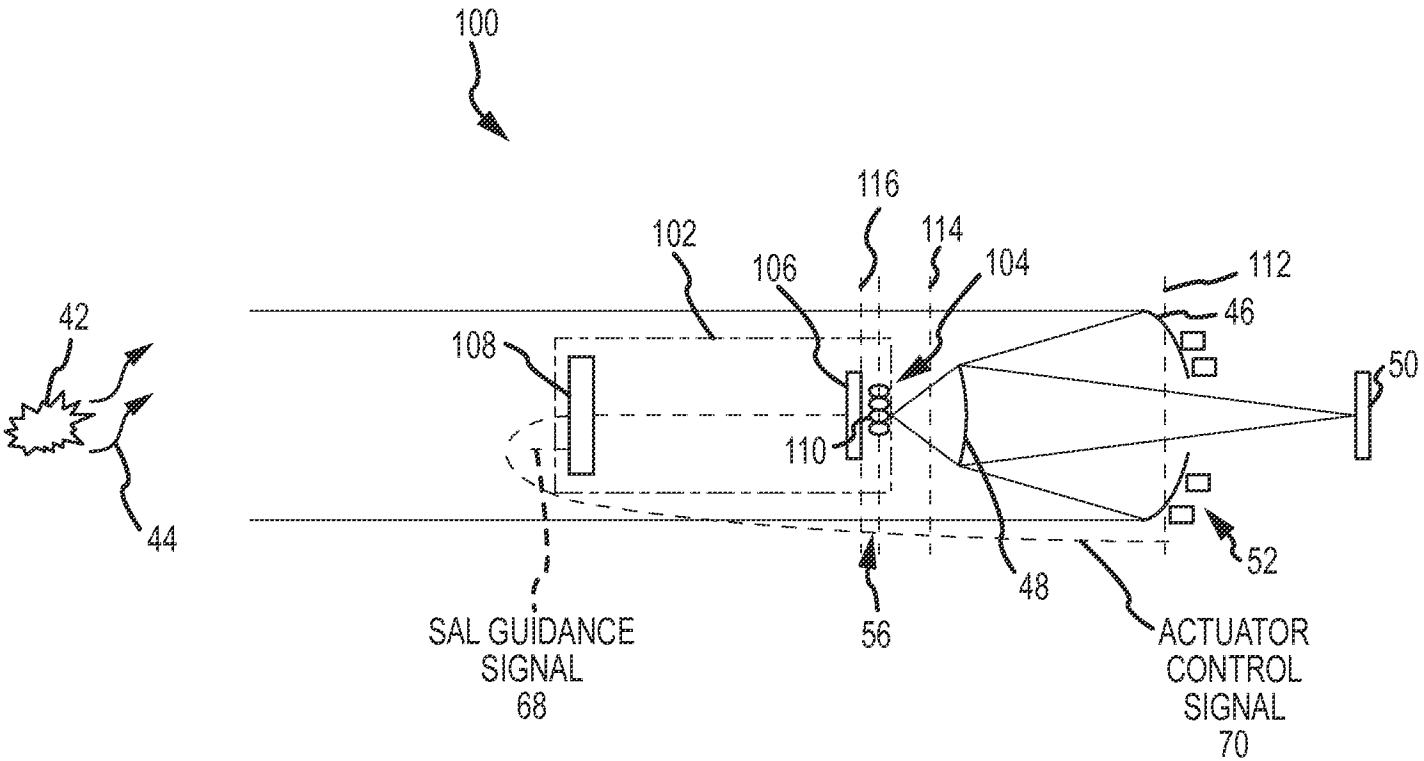

FIG.3d $$SAL_IMAGE(XLENS_k, YLENS_m) = \sum_{i=1}^{M}\sum_{j=1}^{M} Signal(XAP_i, YAP_j, XLENS_k, YLENS_m)$$

$$LOS_ERROR_{AZ} \propto \frac{\sum_{k=1}^{N}\sum_{m=1}^{N} XLENS_{k,m} \cdot SAL_IMAGE(XLENS_k, YLENS_m)}{\sum_{k=1}^{N}\sum_{m=1}^{N} SAL_IMAGE(XLENS_k, YLENS_m)}$$

$$LOS_ERROR_{EL} \propto \frac{\sum_{k=1}^{N}\sum_{m=1}^{N} YLENS_{k,m} \cdot SAL_IMAGE(XLENS_k, YLENS_m)}{\sum_{k=1}^{N}\sum_{m=1}^{N} SAL_IMAGE(XLENS_k, YLENS_m)}$$

DUAL-MODE ELECTRO-OPTIC SENSOR AND METHOD OF USING TARGET DESIGNATION AS A GUIDE STAR FOR WAVEFRONT ERROR ESTIMATION

BACKGROUND OF THE INVENTION

1. Field of the Invention

This invention relates to dual-mode electro-optic (EO) sensors that process both active guidance radiation (e.g. laser radiation from a SAL designator) and passive imaging radiation (e.g. emitted or reflected IR) to provide guidance signals, and more particularly to a dual-mode EO sensor that uses the active guidance radiation from target designation as a guide star for wavefront error estimation of the primary optical element without interfering with the normal operation of the EO sensor. The wavefront error estimate may be used to control actuators to compensate a deformable primary optical element to reduce wavefront errors or to improve an estimate of target position. The estimate may be output and used to redesign the primary optical element.

2. Description of the Related Art

Many guided munitions (e.g. self-propelled missiles or rockets, gun-launched projectiles or aerial bombs) use a dual-mode EO sensor to guide the munition to its target. In a semi-active laser (SAL) mode, the sensor detects active guidance radiation in the form of laser radiation from a SAL designator that is reflected off of the target and locks onto the laser spot to provide line-of-sight (LOS) error estimates. In a passive imaging mode, the sensor detects IR radiation emitted from or reflected off of the target. The sources of IR energy are not artificial; they typically follow the laws of Planck radiation. The source may be the blackbody radiation emitted by the target directly or may, for example, be sunlight that is reflected off of the target. The passive imaging mode may be used to provide LOS error estimates to track the target when SAL designation is not available and may be used at the end of flight to process a more highly resolved image to choose a particular aimpoint on the target or to determine whether or not the target is of interest. The passive imaging mode operates at a much higher spatial resolution than the SAL mode.

A dual-mode sensor comprises a primary optical element having a common aperture for collecting and focusing SAL laser radiation and passive imaging radiation along a common optical path. A secondary optical element separates the SAL laser and passive imaging radiation by spectral band and directs the SAL laser radiation along a first optical path to a SAL detector and directs the passive imaging radiation along a second optical path to an IR imaging detector. The optics spatially encode an angle of incidence of the SAL laser radiation (e.g. a laser spot) at an entrance pupil onto the SAL detector. A quad-cell photodiode provides sufficient resolution to determine the LOS error estimate. The passive imaging radiation from a typical target is at long range, such that the EM wavefront at the sensor is considered to be composed of planar wavefronts. The structure of the target is imprinted on the composite wavefront as a summation of planar wavefronts with different slopes. The optics convert these slopes to spatial offsets in the image plane to form an image of the target on the IR detector.

Ideally the optics convert the incident wavefronts into spherical wavefronts that collapse onto the image plane of the optical system. Given an ideal point source positioned on the optical axis, any deviation from the perfect spherical wavefront (i.e. local slope differences of the wavefront) represents a wavefront error that distorts the image in some way and degrades system performance. These wavefront errors may degrade the high-resolution IR mode performance substantially, while having minimal impact on the much lower resolution SAL mode. Sources of error during assembly and manufacturing can include surface shape defects in the primary and secondary optical elements and mechanical stresses on the optical elements from mounting the EO detector or other components.

During production, an interferometer or Shack-Hartman wavefront sensor may be used to measure a wavefront error estimate to qualify the sensor. The wavefront measurement may also be used to directly compensate the errors via a deformable mirror in some applications. Both the hardware and operation of the interferometer and Shack-Hartman wavefront sensor are expensive. Both require an external EO detector as part of the hardware package. Both require an experienced engineer to perform the test. Neither is suitable for testing in the field.

Once put into the field, the guided munition may be susceptible to different thermal loading conditions that distort the optics, causing wavefront errors. A first order thermal loading is caused by equilibrium thermal conditions that deviate from the production line. For example, a guided munition stored in a launch canister in a desert may be subjected to extreme heat whereas a guided munition on-board an aircraft at high altitudes may be subjected to extreme cold. A second order thermal loading is caused by transient aerodynamic heating once the munition has been launched. Given the typical ratio of sizes between the primary and secondary optical components, the thermal loading effects on the secondary optical elements are typically minimal. This means that in most sensors, the greatest source of distortion is the thermal loading of the primary optical element (e.g. a reflective mirror or lens).

The state-of-the-art to addressing the thermal loading effects is to design the primary optical element to handle a wide range of thermal loading conditions. The primary optical element becomes bigger, heavier and more expensive and the opto-mechanical mounting mechanisms more complex to athermalize the design as much as possible.

SUMMARY OF THE INVENTION

The following is to summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides a dual-mode sensor that generates a wavefront error estimate for the primary optical element in-situ without interfering with the normal operation of the sensor. The wavefront error estimate may be used to deform the primary optical element to reduce wavefront errors or to improve an estimate of target position. Alternately, the wavefront error estimate may be output and used to redesign the primary optical element.

The wavefront error estimate is accomplished by using the active guidance radiation as a "guide star" to generate an artificial point source in the scene that will enter the dual-mode sensor as a planar wavefront. An array of optical focusing elements performs the normal function of spatially encoding an angle of incidence of the active guidance radiation at an entrance pupil onto an active imaging detector. The array also performs an additional function of spatially encoding wavefront tilt deviations emanating from sub-pupils of an exit pupil onto the active imaging detector. The array may be configured to perform the two spatial encodings in parallel or time sequentially. A computer processor (or processors) processes the electrical signals from the imaging detector in accordance with the respective spatial encodings to generate an active guidance signal and a wavefront error estimate for the primary optical element. The passive imaging radiation is collected and processed in the normal manner to provide a passive imaging guidance signal.

A dual-mode sensor comprises a primary optical element having a common aperture for collecting and focusing active guidance radiation and passive imaging radiation along a common optical path and a secondary optical element that separates the active guidance and passive imaging radiation, directing the active guidance radiation along a first optical path and the passive imaging radiation along a second optical path. The primary and secondary optical elements define an entrance pupil and an exit pupil in the first optical path. A passive imaging radiation detector in the second optical path detects focused passive imaging radiation to generate at least one passive imaging guidance signal.

In an embodiment, an active guidance radiation measurement subsystem comprises a lenslet array, an active imaging detector and a processor. The lenslet array is positioned at or near an intermediate image plane formed in the first optical path by the primary and secondary optical elements so that at least two lenslets are illuminated along each axis of the array. The array simultaneously and in parallel spatially encodes an angle of incidence of the active guidance radiation incident at the entrance pupil and spatially encodes wavefront tilt deviations emanating from sub-pupils of the exit pupil onto the active imaging detector. The processor sums the electrical signals from detector pixels behind each lenslet, combines the summations from each lenslet into an active image with a spatial resolution defined by the lenslet array, and determines a position of a target in the active image to generate an active guidance signal. The processor also computes a center of mass for individual detector pixels behind each lenslet that are mapped optically to the same sub-pupil to provide an estimate of the wavefront tilt for each sub-pupil, integrates the estimates to obtain an active wavefront error estimate, and removes known wavefront errors due to the second optical component to provide a wavefront error estimate for the primary optical component.

In another embodiment, an active guidance radiation measurement subsystem comprises an optical relay that defines a collimated space with a relayed exit pupil, an array of switchable optical elements (e.g. a liquid crystal spatial light modulator (SLM)) positioned in the collimated space, an active imaging detector and a processor. The optical relay and SLM together define the array of switchable optical focusing elements. The optical elements are switchable to control transmission there through to perform the two spatial encodings time sequentially. The array is switchable between a first state in which the optical elements are activated with a first spatial pattern to spatially encode an angle of incidence of the active guidance radiation incident at the entrance pupil in an active image onto the active imaging detector and a second state in which the optical elements are activated to trace a single sub-pupil region in a second spatial pattern over the relayed exit pupil to spatially encode wavefront tilt deviations emanating from sub-pupils of the relayed exit pupil in a temporal sequence that is imaged one sub-pupil at a time onto the active imaging detector. The processor processes electrical signals from the detector to determine a position of a target in the active image in the first state to generate an active guidance signal. The processor also computes an estimate of the wavefront tilt for each sub-pupil traced in the second state, integrates the estimates over the relayed exit pupil to provide an active wavefront error estimate and removes known wavefront errors due to the second optical component to provide a wavefront error estimate of the primary optical component.

These and other features and advantages of the invention will be apparent to those skilled in the art from the following detailed description of preferred embodiments, taken together with the accompanying drawings, in which:

BRIEF DESCRIPTION OF HE DRAWINGS

Figure 1A:
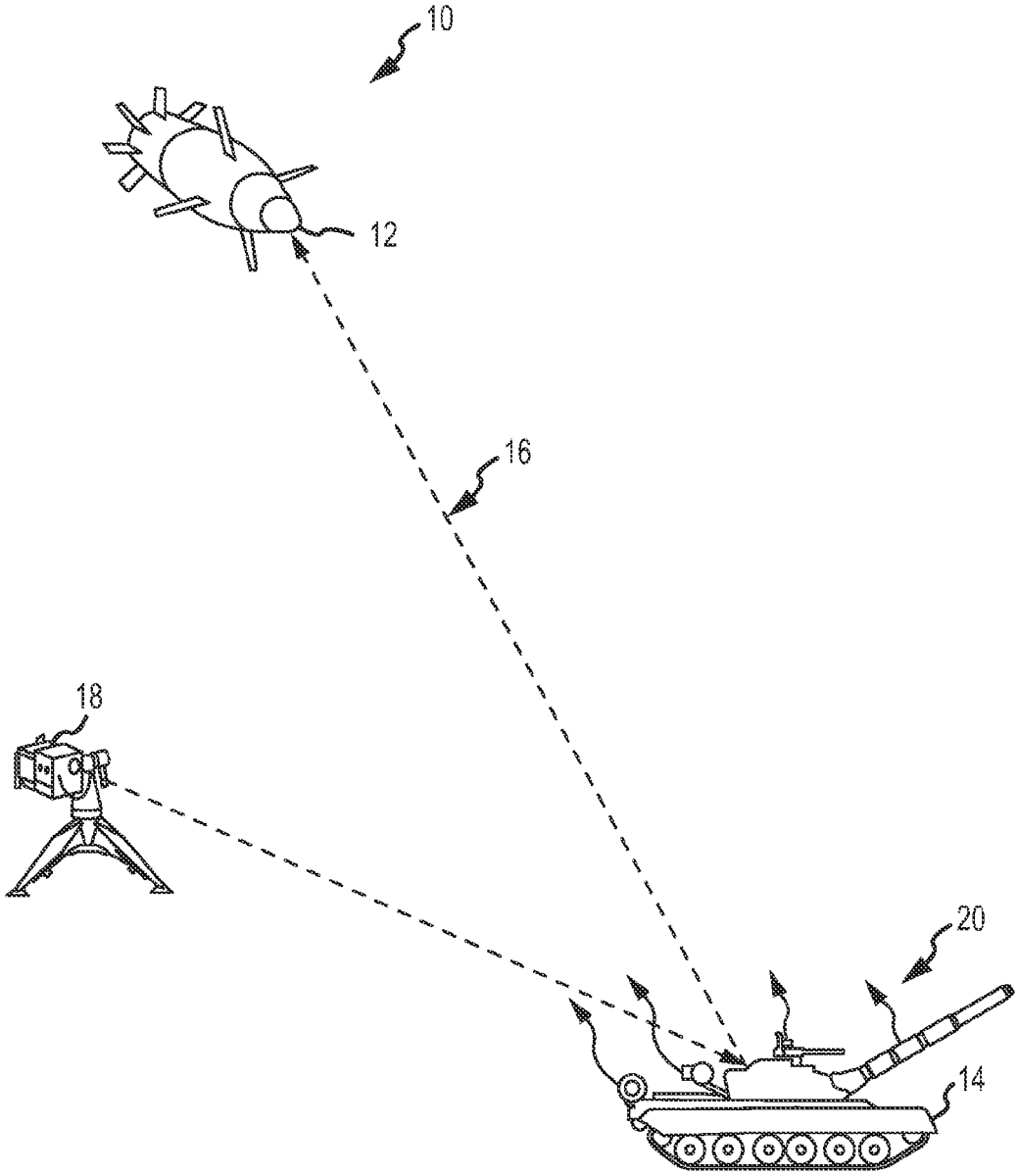
Figure 1B:
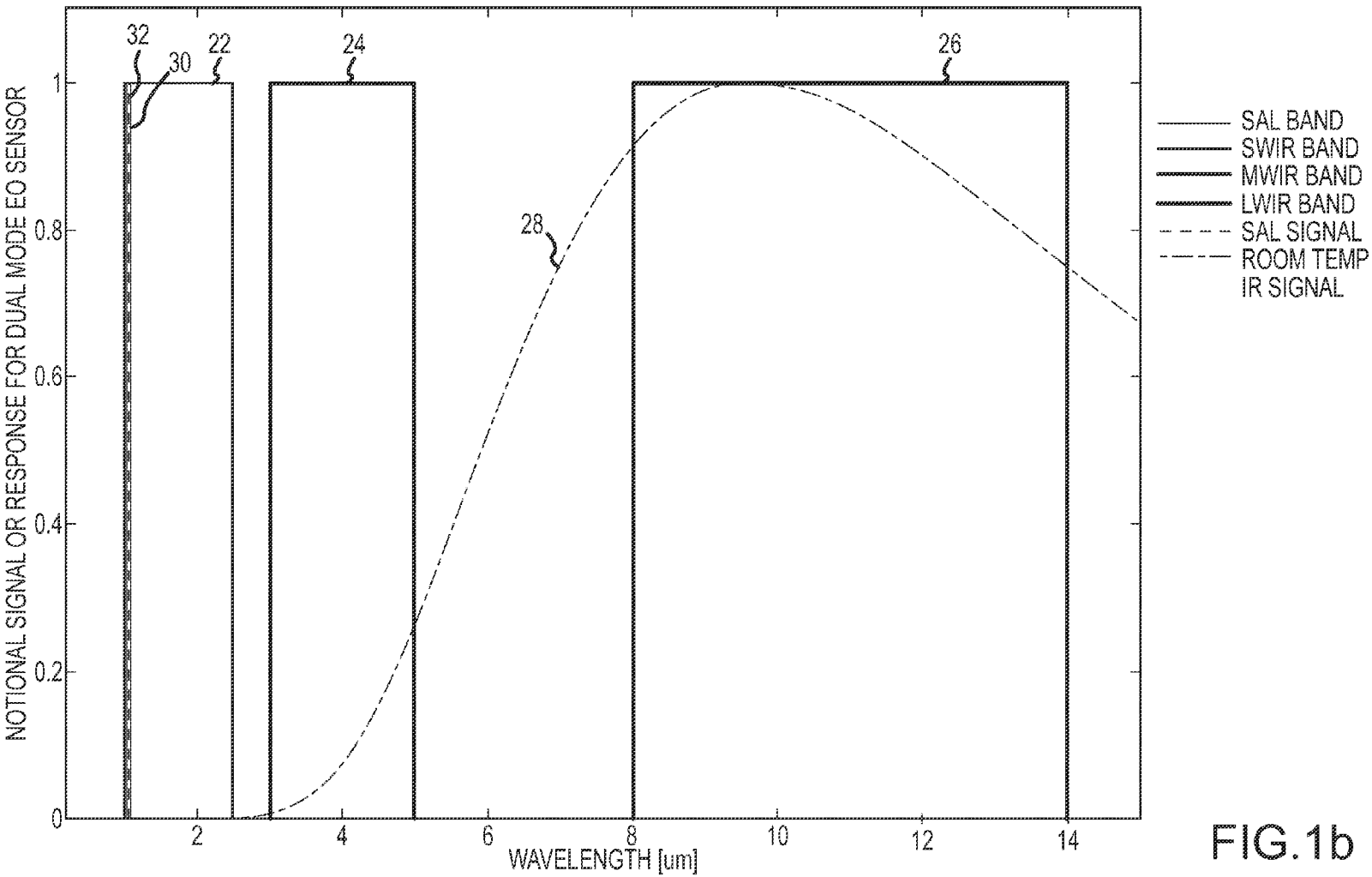
Figure 2:
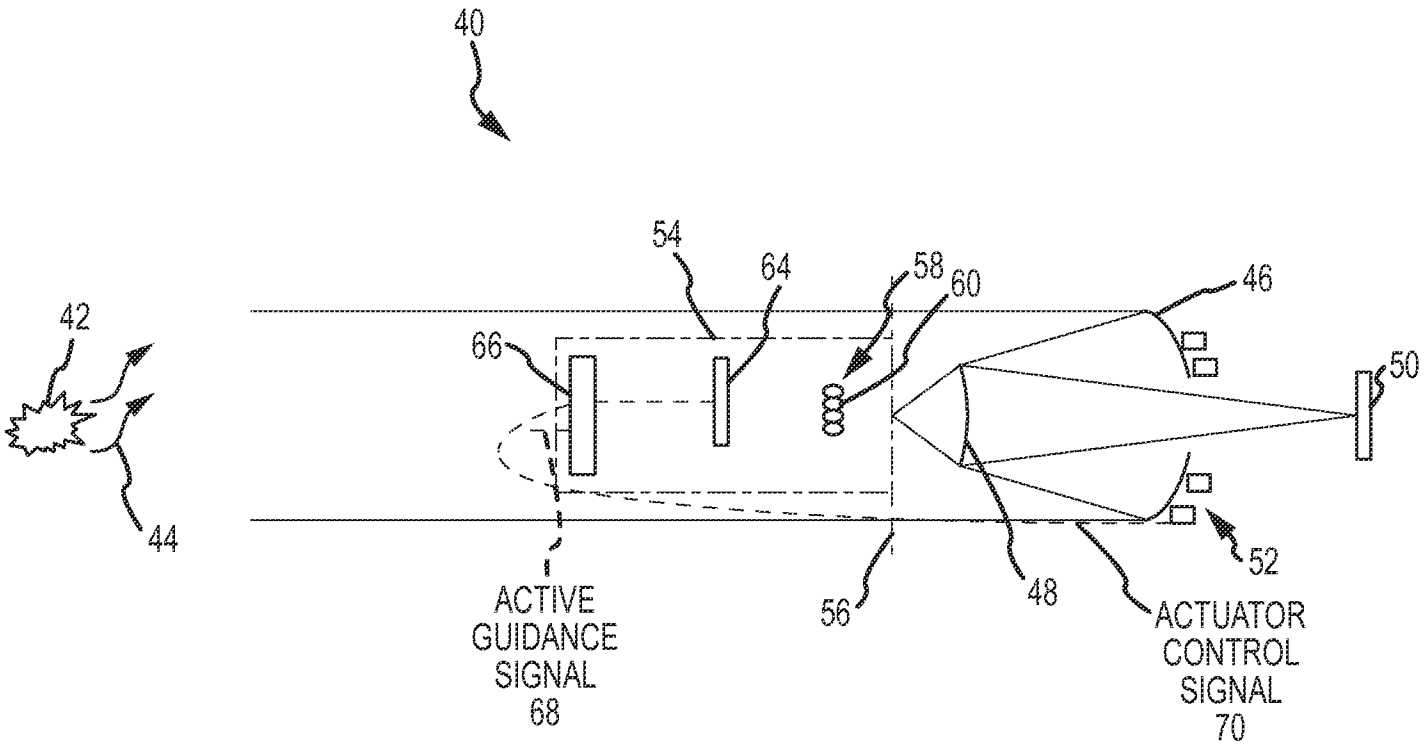
Figure 4A:
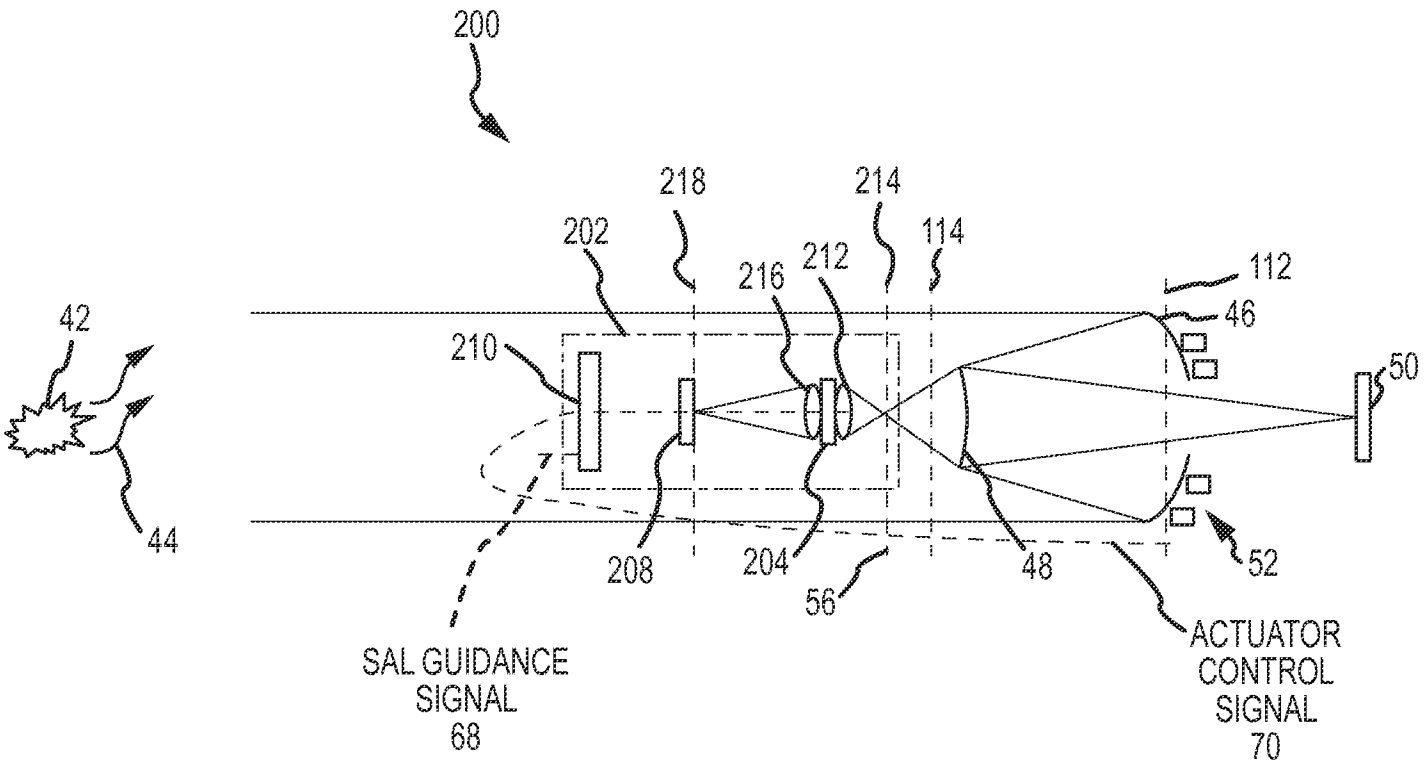
Figure 4B:
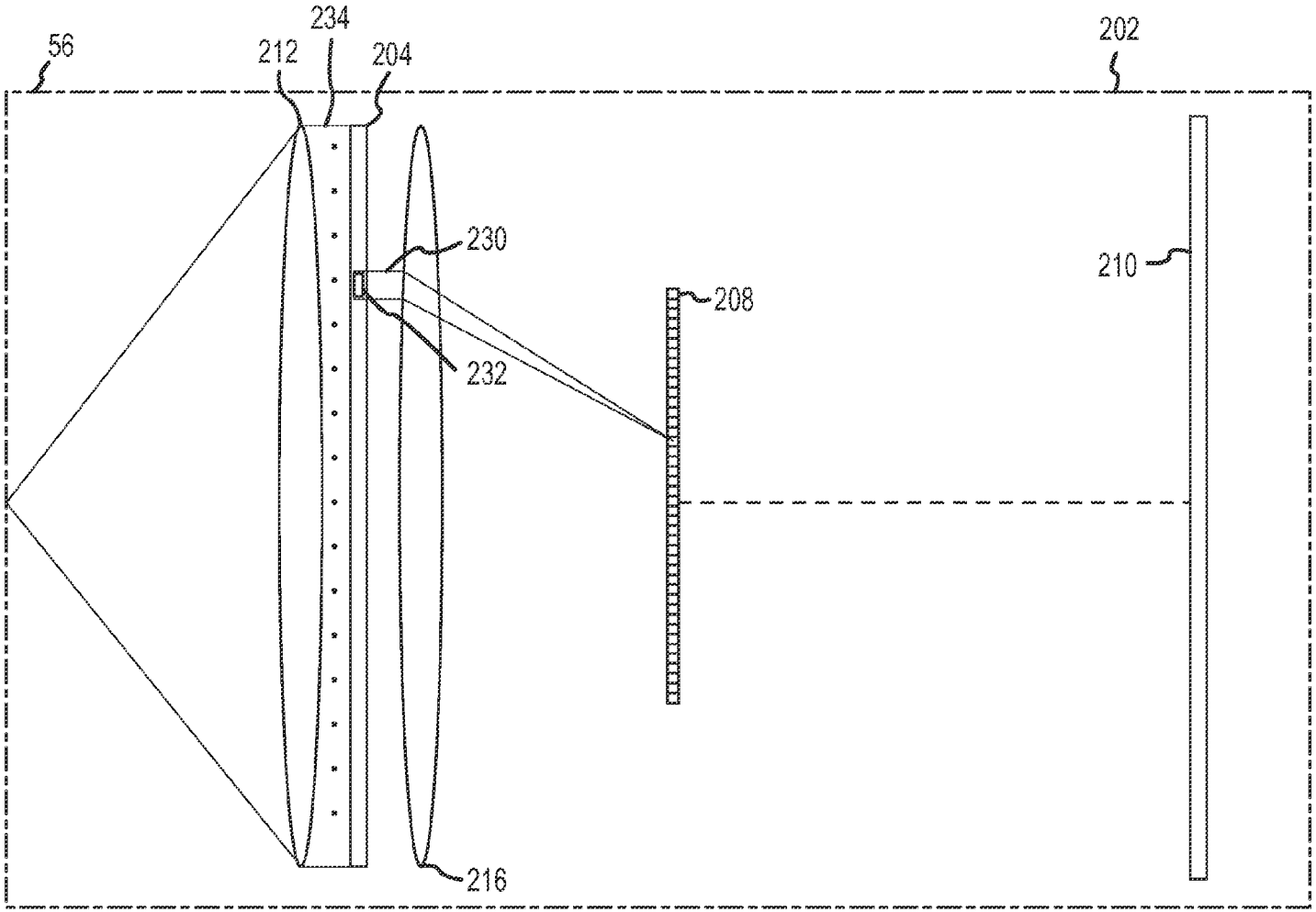
Figure 4C:
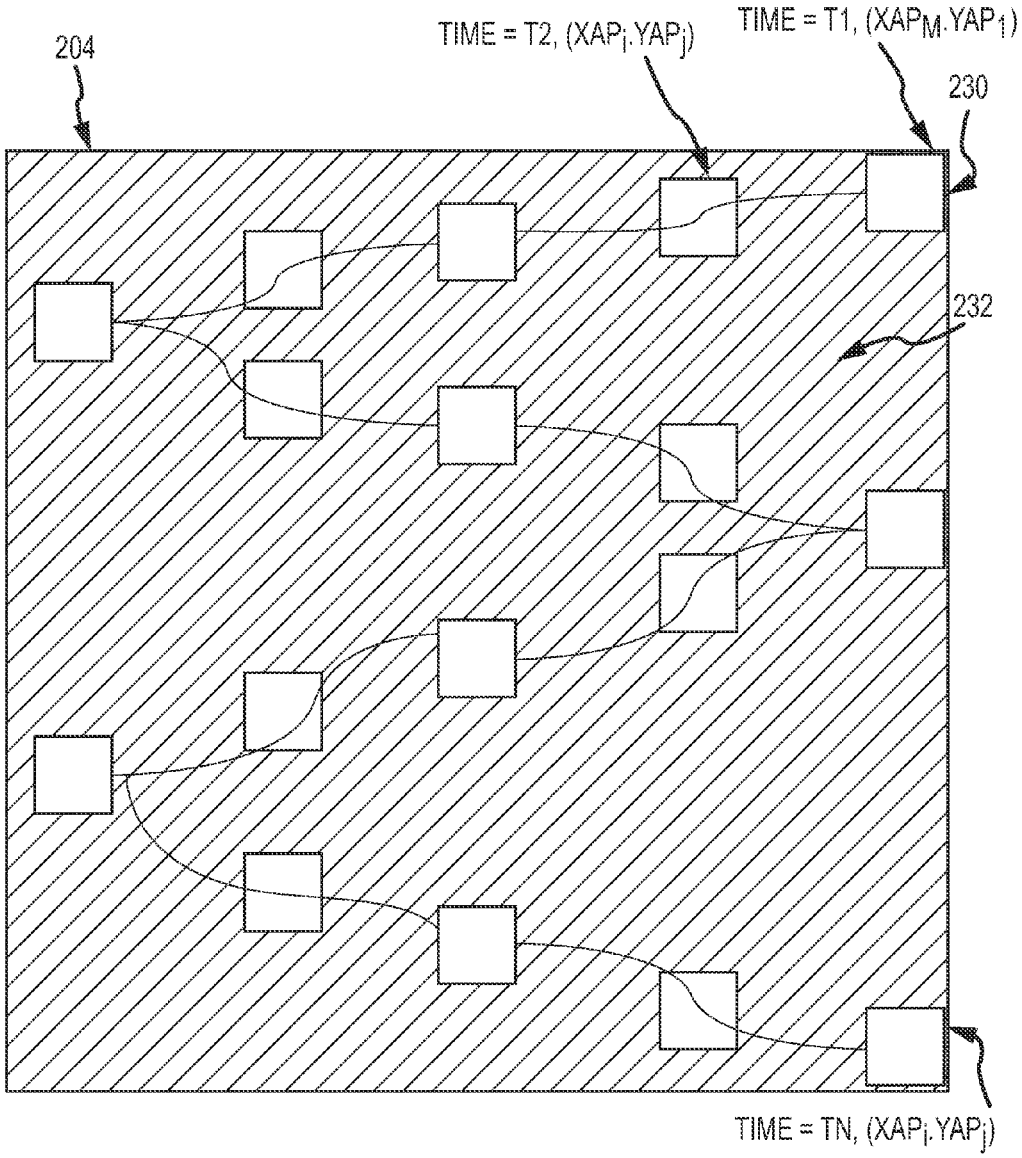
Figure 4D:
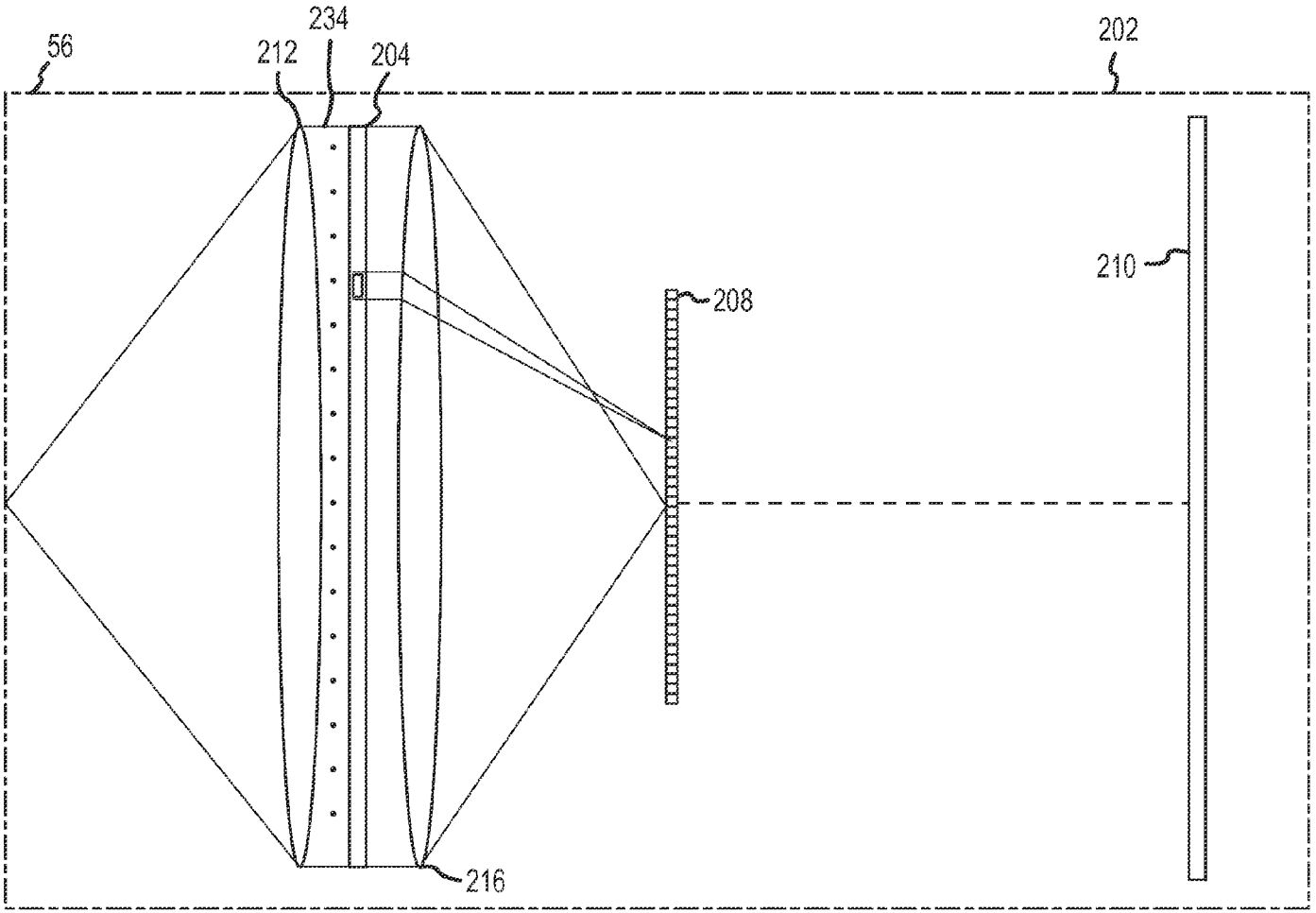
Figure 5:
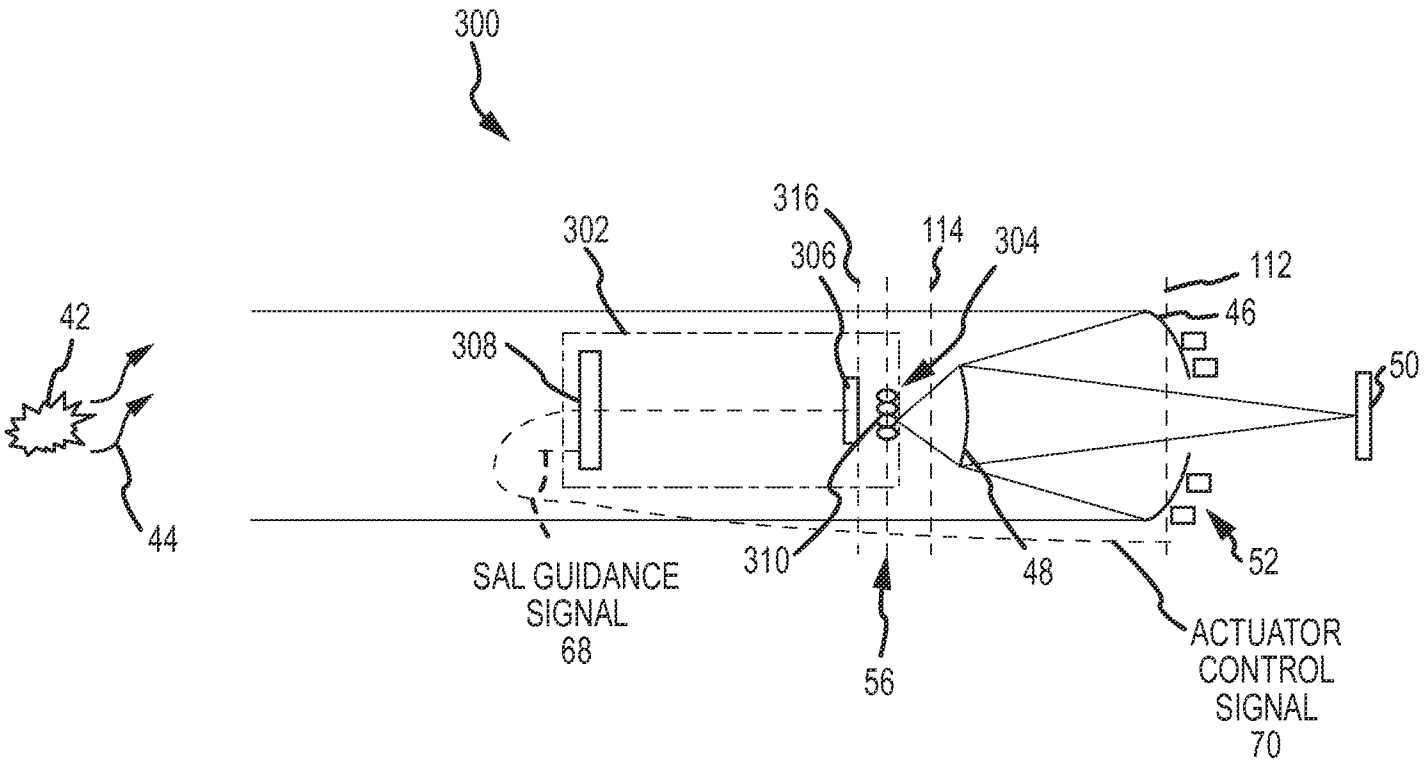

FIGS. 1*a*-1*b* are an illustration of a missile provided with a dual-mode EO sensor for prosecuting a target and a plot of the various passive IR bands and the SAL band, respectively;

FIG. 2 is a block diagram of the dual-mode EO sensor including a SAL measurement subsystem that provides both a SAL image and a wavefront error estimate;

FIGS. 3*a*-3*e* are diagrams of an embodiment using a fixed lenslet array to simultaneously provide the SAL image and wavefront error estimate;

FIGS. 4*a*-4*d* are diagrams of an embodiment using a switchable EO element to provide the SAL image and wavefront error estimate in a time-sequential manner; and FIG. 5 is a block diagram of a dual-mode EO sensor including a SAL measurement system that utilizes an optical phased array (OPA).

DETAILED DESCRIPTION OF THE INVENTION

The present invention provides a dual-mode sensor for a guided munition that generates a wavefront error estimate for the primary optical element in-situ without interfering with the normal guidance operation. The wavefront error estimate is accomplished by using the active guidance radiation as a "guide star" to generate an artificial point source in the scene that will enter the dual-mode sensor as a planar wavefront. An array of optical focusing elements performs the normal function of spatially encoding an angle of incidence of the active guidance radiation at an entrance pupil onto an active imaging detector. The array also performs an additional function of spatially encoding wavefront tilt deviations emanating from sub-pupils of an exit pupil onto the active imaging detector. The array may be configured to perform the two spatial encodings in parallel or time sequentially. A processor processes the electrical signals from the imaging detector in accordance with the respective spatial encodings to generate an active guidance signal and a wavefront error estimate for the primary optical element. The wavefront error estimate may, for example, be used to deform the primary optical element, to redesign the primary optical element, or to improve an estimate of target position. The passive imaging radiation is collected and processed in the normal manner to provide a passive imaging guidance signal.

Without loss of generality, the dual-mode sensor will be described for a configuration in which the active guidance radiation is provided by the laser radiation (NIR, specifically 1064 nm, or possibly SWIR) reflected off a target from a SAL designator. One of ordinary skill in the art will understand a physical beacon attached to the target could provide a point source for the "guide star" as well as the guidance signal. The beacon could emit active guidance radiation in any spectral band e.g. laser energy in NIR or SWIR, visible/NIR or IR as long as the band could be separated from the passive imaging path. One of ordinary skill in the art will also understand that the invention is applicable to multi-mode sensors that include active guidance and passive imaging (e.g. SAL and IR) plus another mode (e.g. millimeter wave).

With reference to the drawings, FIGS. 1*a* and 1*b* depict an exemplary mission scenario for a guided munition 10 provided with a dual-mode sensor 12 to track and prosecute a target 14 (e.g. a tank) using the sensor's SAL and/or passive imaging modes of operation. In the SAL mode, the sensor 12 detects active guidance radiation in the form of laser radiation 16 from a SAL designator 18 that is reflected and/or scattered off of the target 14 and locks onto the laser spot to provide line-of-sight error estimates. In the passive imaging mode, the sensor detects IR radiation 20 emitted from or reflected off of the target due to Planck radiation. The passive imaging mode may be used to track the target when SAL designation is not available and may be used at the end of flight to process a more highly resolved image to choose a particular aimpoint on the target or to determine whether or not the target is of interest. The passive imaging mode operates at a higher spatial resolution than the SAL mode.

The dual-mode sensor 12 includes a passive imaging detector which typically operates in the Short-Wave infrared (SWIR) (1-2.5 um) 22, Mid-Wave infrared (MWIR) (3-5 um) 24, or Long-Wave Infrared (LWIR) (8-14 um) 26 electromagnetic radiation bands as shown in FIG. 1*b*. With currently available technologies, this detector may have a spatial resolution, for example, of anywhere from 32×32 to 4,000×3,000 pixels. Selection of the desired band(s) for the passive imaging sensor depends on the target of interest and the expected atmospheric absorption bands. The SWIR Band 22 is typically used in night conditions to provide high contrast. The MWIR band 24 is selected if the expected targets are relatively hot (e.g. planes, missiles, etc.). The LWIR band 26 is typically used to image targets that have operating temperatures slightly above the standard 300K background. For reference, the Planck spectrum 28 for emissions from a target at room temperature is shown.

The dual-mode sensor 12 also includes an active imaging detector that operates in the spectral band of the active guidance radiation. For a SAL designator this is a narrow band 30, typically centered around the standard Nd:YAG laser line at 1.064 um in the Near IR. While not typically used, alternate lasers are possible, which would shift the SAL band 30 accordingly. The spectral signature 32 of the laser radiation 16 from SAL designator 18 is shown within the SAL sensor bandpass 30.

In accordance with the present invention, the SAL mode of operation is modified to use the active guidance radiation in the form of the SAL laser radiation 16 scattered off target 14 as a "guide star" to provide an artificial point source which will be measured in order to compute a wavefront error estimate for the sensor's primary optical component without interfering with the normal operation of the dual-mode sensor.

Wavefront sensing requires a source at a known distance and with known characteristics. The most reliable way to do this is to create an artificial "guide star." The guide star must be bright enough to provide signal, not overlap considerably with the bandpass of the standard imaging path, and be of known distance and angular size. The known distance and size is used to determine the shape of the input wavefront to disambiguate measurements in the wavefront sensor. The SAL laser designator addresses each of these conditions. By definition the source is bright enough, as it is already being used in the SAL guidance path, and is far enough away to be considered a point source until the very end of flight.

The SAL portion of the dual-mode sensor, hereafter referred to as the active guidance radiation measurement subsystem or the "measurement subsystem" must be modified to implement the new SAL mode of operation to provide both the SAL guidance signal and the wavefront error estimate for the primary optical component. The measurement subsystem includes an array of optical focusing elements that spatially encode an angle of incidence of the active guidance radiation (SAL laser radiation 16) incident at the entrance pupil and spatially encode wavefront tilt deviations emanating from sub-pupils of the exit pupil onto the active guidance radiation (SAL laser radiation 16) at an image plane of the array of optical focusing elements. The array of optical focusing elements may be configured to perform both spatial encodings in parallel or to perform them time-sequentially. An active imaging detector is positioned at the image plane of the array of optical focusing elements to convert the spatially encoded active guidance radiation into an electrical signal. Unlike standard dual-mode sensors in which the SAL detector is typically a quad-cell photodiode, the SAL detector is a high-resolution imaging detector similar to the passive imaging detector. With currently available technologies, this detector may have a spatial resolution, for example, of anywhere from 6×6 to 4,000×3,000 pixels. The additional resolution is needed to provide both the spatial resolution for determining the SAL LOS estimate and the wavefront error estimate. A processor processes the electrical signal in accordance with the respective spatial encodings to generate at least one SAL guidance signal and the wavefront error estimate for the primary optical element. If the SAL mode of operation is designed properly, the use of the SAL laser energy for wavefront error estimation will not impact its traditional use in the guidance system.

With reference to FIG. 2, an embodiment of a dual-mode sensor 40 is responsive to active guidance radiation 42 (SAL laser radiation) and passive imaging radiation 44 (IR emissions or reflected photons due to Planck radiation) to provide active guidance and passive imaging guidance signals and a wavefront error estimate of the primary optical component. The SAL designated target provides both the traditional "laser spot" for SAL guidance and the "guide star" for wavefront estimation. The active (SAL) guidance guidance signal is typically a LOS estimate. The passive imaging guidance signal may be a LOS estimate, an aimpoint on an image of the target or an image of the target for target identification purposes.

Dual-mode sensor 40 includes a primary optical element 46 having a common aperture for collecting and focusing active guidance radiation 42 and passive imaging radiation 44 along a common optical path and a secondary optical element 48 that separates the active guidance and passive imaging radiation. The secondary optical element 48 directs the active guidance radiation 42 along a first optical path and directs the passive imaging radiation 44 along a second optical path. A passive imaging radiation detector 50 in the second optical path detects focused passive imaging radiation to generate at least one passive imaging guidance signal. The primary optical element as shown here is a reflector but could be a lens or lens assembly in other embodiments. As also depicted in this embodiment the primary optical component is deformable and responsive to actuators 52 spaced about is rear surface. The secondary optical element is a dichroic lens that includes a coating that reflects passive (e.g. IR radiation and passes SAL radiation but could be also be a beam splitter with little or no optical power. The secondary optical element will typically have optical focusing power but it is not required. The primary and secondary optical elements define an entrance pupil and an exit pupil in the first optical path. It should be clear to one knowledgeable in the art that the primary and secondary optical elements, may contain many individual optical elements that work in concert, but for now we simply refer to them as the primary and secondary optical element. The point is that the primary optical element provides the collecting aperture and the function of the secondary optical element grouping is to correct for optical aberrations and/or separate the active guidance and passive imaging radiation.

In this embodiment, a measurement subsystem 54 is positioned in the first optical path at or near an intermediate image plane 56 formed by the primary and secondary optical elements. The measurement subsystem 54 includes an array 58 of optical focusing elements 60 that performs two functions, the SAL (or active) measurement function and the wavefront error estimate function, in combination with the primary and secondary optical elements. The SAL measurement function is that of a typical optical system that spatially encodes the angle of incident radiation at the entrance pupil of the system formed by the primary and secondary optical elements. This transformation occurs at the image plane defined by the primary and secondary optical elements and/or any plane that is an optical conjugate of the aforementioned image plane. The SAL measurement function is a result of the standard imaging configuration that provides the ability to form a target LOS error estimate for missile guidance (i.e. photons that are traveling along rays with the same incident angle to the entrance pupil are mapped to the same spatial location at the image plane, while photons at different incident angles are mapped to different spatial locations at the image plane). The wavefront error estimate function is to spatially encode wavefront deviations emanating from sub-pupils of the exit pupil of the optical system in such a way that they do not interfere with the spatial encoding in the SAL measurement function. In this case, the photons that are located within defined sub-pupils of the entire exit pupil are spatially encoded at the image plane of the array of optical focusing elements based on the deviation of the local wavefront tilt from the desired local wavefront tilt for the imaging system defined by the primary and secondary optical elements.

An active imaging detector 64 is positioned at the image plane of the array of optical focusing elements to convert the spatially encoded active guidance radiation into an electrical signal. The active imaging detector 64 has significantly more resolution than what is typical in a standard SAL EO Sensor. While the number of pixels is a system design consideration and could consist of any number of pixels, a standard CCD device in the megapixel class is sufficient, while the typical SAL system usually employs a detector with four pixels in a quad-cell photodiode configuration.

A processor (or processors) 66 processes the electrical signal in accordance with the respective spatial encodings to generate at least one active guidance signal 68 and a wavefront error estimate for the primary optical element. The processor utilizes a priori information about the spatial encodings provided by the combination of the array of optical focusing elements and the primary/secondary optical elements to extract the desired electrical signals for processing of the SAL image measurement data as well as the wavefront error estimation data. These mappings are provided by the two functions of the array of optical focusing elements as discussed above. The processor then determines the LOS error to the target for the SAL guidance signal from the encoded SAL image measurement data. As required, the processor will utilize the encoding performed by the array of optical focusing elements to provide a wavefront error estimate that can be used to generate an actuator control signal 70 to form a control loop for the actuators 52 on the deformable primary optical element 46 via the wavefront error estimation data. The actuators on the primary optical element will deform the optical element via the control signal in an effort to provide the desired imaging performance in both the Semi-Active Laser and passive imaging modes of the dual mode EO sensor. Alternatively, the wavefront error estimate can be used to update knowledge of the current wavefront error, which might be used in a variety of ways to improve algorithmic performance without the use of a closed-loop adaptive optical system.

The optical function for wavefront error estimation is to map sub-pupil locations of the system pupil to the detector. This can be accomplished in a few different ways. One method is via a plenoptic configuration with an array of lenslets at or near the focal plane of the telescope. The plenoptic or array of lenslets consists of a plurality of individual optical focusing elements that are placed very near each other in the plane orthogonal to the optical axis of the system. The number of focusing elements and their pitch (one-dimensional width) depends on many different system design parameters, but they are typically made with a pitch size between 100 microns and 1 millimeter. This parallel approach achieves this by providing two output functions. First, each pixel response to the active guidance radiation behind the individual lenslets can be summed to form the signal output for as lenslet. When these are stitched together, an image is formed with the resolution defined by the individual lenslet size. In this way the lenslet is effectively the pixel for the standard SAL imaging path. Second, the individual pixels behind each lenslet carry information about the tilt of the wavefront for the sub-pupil that the pixel maps to. A center of mass or centroid calculation for the pixels that map to the same sub-pupil position provides the wavefront slope at the sub-pupil location. Integration of the sub-pupil wavefront slopes provides the wavefront error estimate across the pupil with a spatial resolution defined by number of pixels assigned to each lenslet.

Another method is via a liquid crystal spatial light modulator (SLM) or other pixel-addressable light modulator. In this case the outputs are achieved sequentially. The SAL guidance image may be formed by turning all (or a known spatial pattern) of the LCD pixels "on" such that they transmit the full signal through the entire pupil. Alternately, Coded Aperture techniques may be used to pass a particular spatial pattern. The image is then formed via a standard optical system. The wavefront error estimate is formed by turning a small region of the LCD on and serially scanning that sub-pupil through the pupil at the desired resolution.

A hybrid method between the two aforementioned methods is via an Optical Phased Array (OPA) or other pixel-addressable optical phase modulator. In this case the active guidance and wavefront estimate signal outputs are achieved sequentially. The SAL guidance image may be formed by controlling all (or a known spatial pattern) of the OPA pixels, such that their optical power is negligible. In this state the active guidance radiation is transmitted in a normal fashion and an image of the radiation is formed. The wavefront error measurement is formed by controlling all (or a known spatial pattern) of the OPA pixels to create, for example, an array of optical focusing elements. This state provides a standard Shack-Hartmann wavefront sensor configuration.

Referring now to FIGS. 3*a*-3*e*, an embodiment of a dual-mode EO sensor 100 comprises a measurement subsystem 102 in which a fixed lenslet array 104 simultaneously provides both spatial encodings to form the SAL image and provide wavefront error estimate in a manner that the SAL image measurement SNR and update are not impact by the collection of the additional wavefront error information. The primary and secondary optical elements 46 and 48, passive imaging detector 50 and actuators 52 are as previously described.

Measurement subsystem 102 comprises lenslet array 104, an active imaging detector 106 and a processor 108. The lenslet array is positioned at or near the intermediate image plane 56 formed in the first optical path by the primary and secondary optical elements so that at least two lenslets 110 are illuminated along each axis of the array. The array spatially encodes an angle of incidence of the active guidance radiation incident at the entrance pupil 112 and spatially encodes wavefront tilt deviations emanating from sub-pupils of the exit pupil 114 onto the active imaging detector 106 at the focal plane 116 of the lenslet array. The processor 108 sums the electrical signals from detector 106 pixels behind each lenslet 110, combines the summations from each lenslet into a SAL image with a spatial resolution defined by the lenslet array, and determines a position of a target in the SAL image to generate the active guidance signal 68. The processor 108 also computes a center of mass for individual detector pixels behind each lenslet that are mapped optically to the same sub-pupil to provide an estimate of the wavefront tilt for each sub-pupil, integrates the estimates to obtain an active wavefront error estimate across the exit pupil, and removes known wavefront errors due to the secondary optical element to provide a wavefront error estimate for the primary optical element. The wavefront error estimate can be used to generate actuator control signal 70 to form a control loop for the actuators 52 on the deformable primary optical element 46.

The two spatial encodings are performed in parallel, and in such a way that the traditional SAL image measurement SNR (signal-to-noise ratio) and update rate are not impacted by the collection of the additional wavefront error information. The parallel nature of the two functions is accomplished because of the unique position of the lenslet array 104 and active imaging detector 106 within the measurement subsystem. Because the lenslets are placed at or near the intermediate image plane 56, with the imaging detector 106 at the focal plane of the lenslets, all the electrical signals associated with pixels behind a given individual lenslet 110 can be summed to provide an estimate of the total collected energy for an individual lenslet at the intermediate image. If all of the signals associated with each lenslet are summed, a SAL image is formed with the resolution defined by the lenslet array. While this resolution is by default lower than that provided by the imaging detector itself, it can be much higher than what is typically found in a standard SAL quad-cell detector. In addition, individual pixels can be mapped to the exit pupil of the primary and secondary optical elements. Because multiple pixels are mapped to the same sub-pupil regions of the exit pupil but correspond to different sub-pupil wavefront tilts, these pixels can also be combined to form an estimate of the wavefront error.

Figure 3B:
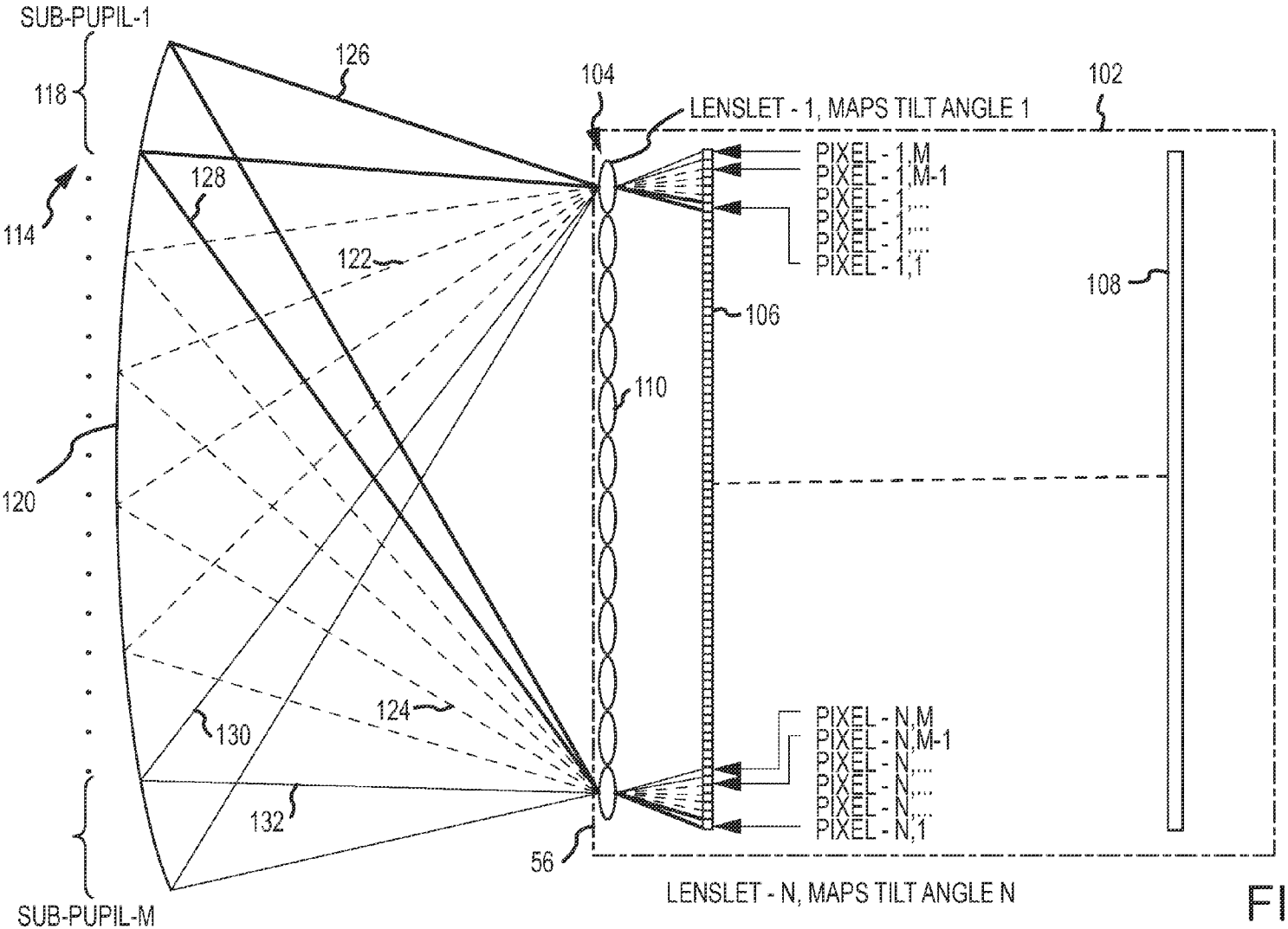

FIG. 3*b* illustrates the spatial encodings of the active guidance radiation via the measurement subsystem 102 in a 1d cross-section of the subsystem. This figure is only intended to illustrate the spatial encoding/mapping function of the optical system. In operation, the "spot" of the active guidance radiation would illuminate at least two lenslets in each axis of the lenslet array.

In this figure the exit-pupil 114 of the primary and secondary optical elements is sub-divided into seven distinct sub-pupils 118 (this number was chosen for convenience of display only, more or less sub-pupil measurements will suffice and the optimum number is governed by a number of factors that would be included in a system design optimization). At the exit pupil 114, a curve 120 denotes the typical wavefront that would be emanating from the exit pupil 114. The intermediate image plane is at or near the plane of the lenslets 56. The lenslets are positioned such that the active guidance radiation illuminates at least two lenslets in each axis of the lenslet array. To highlight the fact that any number of sub-pupil sectioning is possible the distinct sub-pupil divisions are labeled (1 to M).

Rays 122 and 124 show how light might travel in the sub-pupil regions between sub-pupil 1 and sub-pupil M in two different tilt configurations, denoted as tilt angle 1 and tilt angle N. Lenslet 1 maps tilt angle 1 for rays 122 and Lenslet N maps tilt angle N for rays 124. Rays 126 and 128 show how light would propagate from sub-pupil 1 in these two tilt configurations. Rays 130 and 132 do the same for sub-pupil M.

Lenslet array 104 is placed at the intermediate image plane 56. The light that enters Lenslet 1 is then mapped to a series of pixels (1 to M) on the active imaging detector 106 and the same occurs with Lenslet N. In this case Pixel 1 (lenslet index), M maps the light traveling from sub-pupil M due to the wavefront tilt angle 1. Alternatively, Pixel N,M maps the light traveling from sub-pupil M due to the wavefront tilt angle N error. Any tilt angle state is possible from a max tilt of 1 to a minimum tilt of N (even though only two states have been shown for ease of display).

While any number of estimation techniques might be employed, a common method due to its efficiency would be to compute a center of mass calculation for the electronic signal from each pixel that is mapped to a specific sub-pupil 118. The center of mass or centroid calculation provides an estimate of the wavefront tilt in that sub-pupil. Integration of these estimates of wavefront tilt for the different sub-pupils produces a wavefront error estimate. A summation of all the electronic signals that are mapped to a particular lenslet gives the entire photon flux that was incident on a particular lenslet at the intermediate image plane and absorbed by the pixels associated with that lenslet. If all the signals for each lenslet are added and then stitched together based on the lenslet orientation in the intermediate image plane, the SAL image at that plane is recovered at the resolution defined by the focal length of the primary and secondary optical element combination and the lenslet pitch (the diameter of an individual lenslet). While this SAL image has inherently lower resolution than what would be possible with the active imaging detector 106, it can still be well above what is traditionally found in SAL quad-cell detectors. The processor 108 provides a mechanism to use the a priori information of these pixel/lenslet mappings to the intermediate image and exit pupil in order to carry out the calculations described above as well as any other calculations that might be necessary to provide control signals to the missile guidance and/or actuator system on the deformable primary mirror.

Figure 3C:
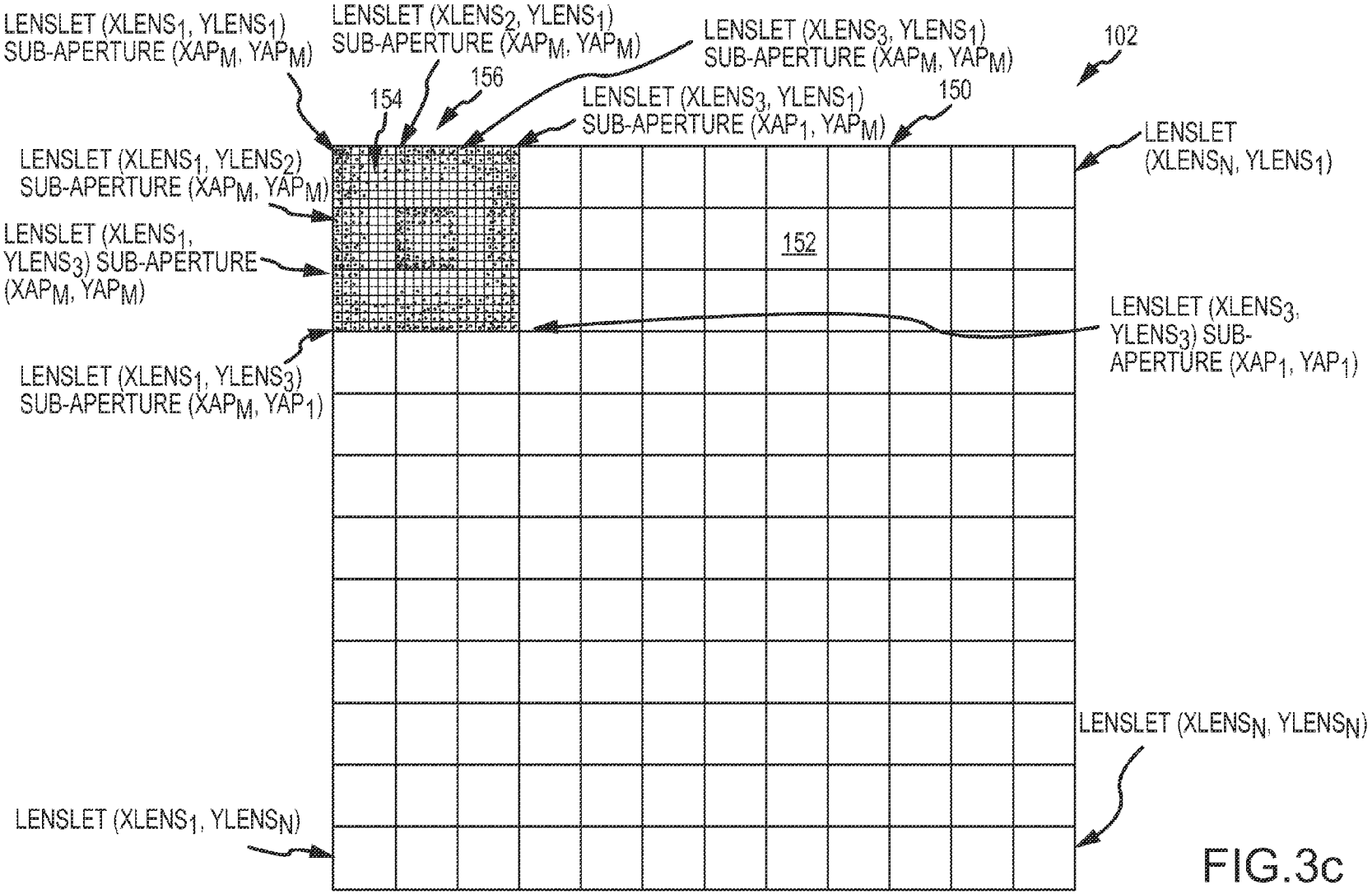
Figure 3E:
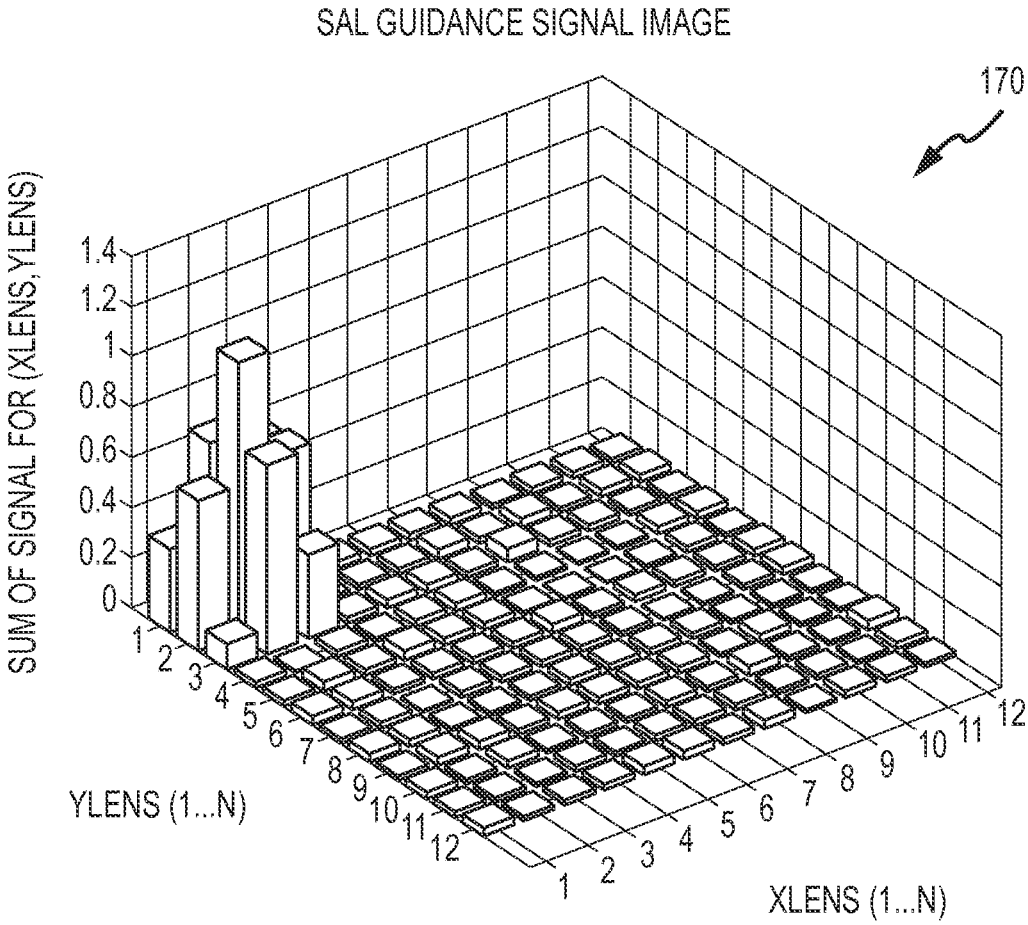

FIG. 3*c* illustrates the spatial encodings of the active guidance radiation via the measurement subsystem 102 in a 2d cross-section at the active imaging detector 106. The figure is meant to give a detailed look at the mapping of individual detector pixels in a 2d setting. The large square 150 is the footprint of the active imaging detector 106. The medium sized squares 152 inscribed in the larger square 150 denote the pixels that are mapped to a particular lenslet (XLENS1 . . . XLENSN, YLENS1 . . . YLENSN). The small squares 154 represent individual pixels in the active imaging detector 106. Each pixel within an individual lenslet mapped region in the active imaging detector maps to a particular sub-pupil location in the exit pupil (XAP1 . . . XAPM, YAP1 . . . YAPM). This means that every pixel is mapped into a four-dimensional space (XLENS,YLENS,XAP,YAP). The figure also displays an example measurement in the upper left corner. In this case a SAL image 156 lands in XLENS1 . . . 3,YLENS1 . . . 3. FIG. 3*d* will show how this data is sampled to perform the wavefront error estimate function. FIG. 3*e* will show how this data is sampled to perform the SAL image measurement function.

FIG. 3*d* is a graphical representation in the form of a bar plot 160 of the mapped signal for a particular sub-pupil (XAP4,YAP4). The bar plot displays the amplitude level for all the pixels that map to XAP4,YAP4 (i.e. XLENS1 . . . N,YLENS1 . . . N,XAP4,YAP4). Any number of image processing techniques could be used at this point to estimate the center of mass for this signal. In this figure, a centroid calculation is performed on the data to provide an estimate of the wavefront tilt at the sub-pupil region (denoted by i, j in the equation). When all of these estimates are integrated together using standard wavefront reconstruction algorithms an estimate of the wavefront error across the entire exit pupil is computed.

FIG. 3*e* shows a graphical representation in the form of a bar plot 170 of the mapped signal for the SAL image. The bar plot displays the summation of the amplitude level for all the pixels that map to a particular lenslet, stitched together to form an the image of SAL spot (i.e. XLENS1 . . . N,YLENS1 . . . N,sum(XAP1 . . . M, YAP1 . . . M)). Once the data is summed and "stitched" into this format any number of image processing algorithms can be used to estimate the position of the target to provide the active guidance signal.

Referring now to FIGS. 4*a*-4*d*, an embodiment of a dual-mode EO sensor 200 comprises a measurement subsystem 202 in which a liquid crystal spatial light modulator (SLM) 204 provides the spatial encodings to form the SAL image and provide the wavefront error estimate time-sequentially in a manner that the SAL image measurement SNR and update are not impact by the collection of the additional wavefront error information. The primary and secondary optical elements 46 and 48, entrance and exit pupils 112 and 114, passive imaging detector 50 and actuators 52 are as previously described.

Measurement subsystem 202 comprises an optical relay 206 that defines a collimated space with a relayed exit pupil, SLM 204 that provides an array of switchable optical elements positioned in the collimated space, an active imaging detector 208 and a processor 210. The optical relay and SLM together define the array of switchable optical focusing elements. Optical relay 206 includes a collimating optic 212 positioned with its focal plane 214 coincident with the intermediate image plane 56 and a focusing optical element 216 positioned with its rear focal plane 218 coincident with the image plane and active imaging detector 208.

The optical focusing elements are switchable (i.e. the SLM voxels are set "open" or "on") to control transmission there through to perform the two spatial encodings time sequentially. The SLM 204 is switchable between a first state in which the optical elements are activated with a first spatial pattern (e.g. all Voxels open or using Coded Aperture or pupil apodizing techniques) to spatially encode an angle of incidence of the active guidance radiation incident at the entrance pupil in a SAL image onto the active imaging detector and a second state in which the optical elements are activated to trace a single sub-pupil region in a second spatial pattern over the relayed exit pupil to spatially encode wavefront tilt deviations emanating from sub-pupils of the relayed exit pupil in a temporal sequence of sub-pupils that are imaged one sub-pupil at a time onto the active imaging detector. The processor processes electrical signals from the detector to determine a position of a target in the SAL image in the first state to generate an active guidance signal. The processor also computes an estimate of the wavefront tilt for each sub-pupil traced in the second state, integrates the estimates over the relayed exit pupil to provide an active wavefront error estimate and removes known wavefront errors due to the second optical component to provide a wavefront error estimate of the primary optical component.

The SAL measurement function associated with the first spatial encoding is that of a typical optical system that spatially encodes the angle of incident radiation at the entrance pupil of the system formed by the primary and secondary optical elements. This transformation occurs at the image plane defined by the primary and secondary optical elements and/or any plane that is an optical conjugate of the aforementioned image plane. In this embodiment the intermediate image plane 56 is relayed to the plane of the active imaging detector 208 with the spatial light modulator 204 set to a condition that transmits as much energy as possible through the entire entrance pupil (i.e. the SLM voxels are set "open" or "on"). Alternately coded aperture techniques could be uses to turn some voxels on and some off in a spatial pattern or a pupil apodizing technique might be used where a gradient of transmission through the SLM is utilized. A mismatch of the focal lengths in the relay optics can be used to magnify/demagnify the intermediate image to any desired size. The active measurement function is a result of the standard imaging configuration that provides the ability to form a target line-of-sight error estimate for munition guidance.

The wavefront error estimation function associated with the second spatial encoding is to spatially encode wavefront deviations from the exit pupil of the optical system in such a way that they do not interfere with the spatial encoding in the active measurement function. In this embodiment, the photons that are located within defined sub-pupils of the entire exit pupil are spatially encoded on the active imaging detector 208 in a time sequence between the normal guidance updates. This might be achieved in the case of SAL based active guidance radiation via an increase in the pulse repetition frequency (PRF) of the designator above that which is required for normal guidance updates. This temporal sequencing through the pupil is possible because of the addition of spatial light modulator 204 in the relayed exit pupil. By sequencing through known positions where the SLM is only "on" for a particular sub-pupil, a temporal sequence of the deviation of the local wavefront tilt from the desired local wavefront tilt for the imaging system defined by the primary and secondary optical elements can be made. The encoded wavefront deviations are integrated over time to provide additional information to the dual mode EO sensor about the current state of its imaging system.

in this embodiment, the two functions are performed in sequence, and in such a way that the traditional SAL image measurement SNR and update rate are not impacted by the collection of the additional wavefront error information. As mentioned previously, the active imaging detector is placed downstream at or near the rear focal plane 218 defined by the second relay optic 216 to convert the encoded incident electromagnetic radiation into an electrical signal that is passed to the processor 210. The time sequenced nature of the two functions is accomplished because of the unique position of the spatial light modulator 204, relay optics 212 and 216, and active imaging detector 208 within the measurement subsystem 202.

Because the spatial light modulator 204 is placed in the exit pupil space, with the active imaging detector 208 at the relayed image plane 218, all the electrical signals associated with a time where a sub-pupil of the SLM is turned "on" can be used to provide an estimate of the local wavefront tilt error for that sub-pupil. In addition, because the sub-pupils are sequenced in time, the entire field of the active imaging detector 208 can be used to compute a wavefront tilt estimate, dramatically increasing the available dynamic range of tilt measurements possible.

If all of the "voxels" within the SLM are turned "on", a SAL mage is formed with the resolution defined by the active imaging detector 208 itself. This too is a significant increase in the spatial resolution of the SAL Image (i.e. the increase in resolution is as factor of M where M is the number of sub-pupils). Alternately coded aperture techniques could be used to turn some voxels on and some off in a spatial pattern or a pupil apodizing technique might be used where a gradient of transmission through the SLM is utilized in an effort to extract guidance information. In this configuration, under ideal conditions, both functions of the measurement subsystem 202 are performed in an optimized way, except for the fact that the measurements are taken in series and any wavefront degradation over the time required to take the necessary series of measurements will increase the noise in the wavefront error estimation. The processor 208 can be designed to optimally utilize the a priori information about the encoding provided by the combination of the optical relay, SLM and primary/secondary optical elements to extract the desired electrical signals for processing of the SAL image measurement data as well as the wavefront error measurement data. The processor determines the line-of-sight error to the target for the active guidance signal 68 from the SAL Image measurement data. As required, the processor provides a wavefront error estimate that can be used to generate the actuator control signal 70 to form a control loop for the actuators on the deformable primary optical element via the wavefront error measurement data. The actuators 52 on the primary optical element 46 deform the optical element via the control signal in an effort to provide the desired imaging performance in both the active guidance and passive imaging modes of the dual mode EO sensor. Alternatively, the wavefront error estimate can be used to update knowledge of the current wavefront error, which might be used in a variety of ways to improve algorithmic performance without the use of a closed-loop adaptive optical system.

FIG. 4*b* shows the configuration where a single sub-pupil 230 is allowed to transmit through the spatial light modulator (a single "voxel" or group of neighboring "voxels" 232 is turned "on"). In this case a relayed exit pupil 234 is mapped to the collimated space between the two relay optics 212, 216, because the first relay optic 212 is placed such that is front focal plane intersects at or near the intersection of the intermediate image plane 56 and the measurement subsystem 202. The SLM 204 is placed in the mapped exit pupil space so that it can sample individual sub-pupils 230 in any desired temporal sequence to trace a spatial pattern across the pupil. The sub-pupils can be adapted in spatial extent and location in order to minimize the time required to measure the necessary information content to make an accurate wavefront estimate while impacting the standard SAL guidance path minimally. The second relay optic 216 is placed such that the its rear focal plane intersects at or near the plane of the active imaging detector 208. This placement allows the standard image and the sub-pupil sampling to be relayed onto the active imaging detector 208. The processor 210 is then connected to the imaging detector 208 to receive and process the electrical signals output by the detector, utilizing information about the sequencing of the different states in the spatial light modulator.

FIG. 4*c* illustrates an embodiment of a temporal sequence of states within the spatial light modulator 204 to trace a single sub-pupil 230 in a spatial pattern 232 across the pupil to estimate the wavefront error across the exit pupil. Because the SLM can be electronically addressed, any spatial pattern or site of sub-pupil (down to the native resolution of the SLM) can be used to provide wavefront information.

FIG. 4*d* shows the spatial light modulator 204 in an "all-open" configuration so that the entire SAL image can be formed. In this case the entire relayed exit pupil 234 is mapped to the space between the two relay optics, because the first relay optic 212 is placed such that is front focal plane intersects at or near the intersection of the intermediate image plane 56 and the measurement subsystem 202. The SLM 204 is placed in the mapped exit pupil space so that it can sample individual sub-pupils in any desired temporal sequence across the pupil. In this embodiment all of the "voxels" are turned to the state where they transmit as much incident radiation as possible. In this case, the entire wavefront (not just a sub-pupil 230 as in 4*b*/4*c*) is transmitted to the second relay optic 216. The second relay optic 216 is placed such that the its rear focal plane intersects at or near the plane of the active imaging detector 208. This placement allows the standard image and the sub-pupil sampling to be relayed onto the imaging detector. The processor 210 is connected to the active imaging detector 208 to receive and process the electrical signals output by the imaging detector, utilizing information about the sequencing of the different states in the spatial light modulator.

Referring now to FIG. 5, an embodiment of a dual-mode sensor 300 is responsive to active guidance radiation 42 (SAL radiation) and passive imaging radiation 44 (IR emissions or reflected photons due to Planck radiation) to provide active guidance and passive imaging guidance signals and a wavefront error estimate of the primary optical component. The SAL designated target provides both the traditional "laser spot" for SAL guidance and the "guide star" for wavefront estimation. The active (SAL) guidance guidance signal is typically a LOS estimate. The passive imaging guidance signal may be a LOS estimate, an aimpoint on an image of the target or an image of the target for target identification purposes.

Dual-mode sensor 300 includes a primary optical element 46 having a common aperture for collecting and focusing active guidance radiation 42 and passive imaging radiation 44 along a common optical path and a secondary optical element 48 that separates the active guidance and passive imaging radiation. The secondary optical element 48 directs the active guidance radiation 42 along a first optical path and directs the passive imaging radiation 44 along a second optical path. A passive imaging radiation detector 50 in the second optical path detects focused passive imaging radiation to generate at least one passive imaging guidance signal. The primary optical element as shown here is a reflector but could be a lens or lens assembly in other embodiments. As also depicted in this embodiment the primary optical component is deformable and responsive to actuators 52 spaced about is rear surface. The secondary optical element is a dichroic lens that includes a coating that reflects IR radiation and passes SAL radiation but could be also be a beam splitter with little or no optical power. The secondary optical element will typically have optical focusing power but it is not required. The primary and secondary optical elements define an entrance pupil and an exit pupil in the first optical path. It should be clear to one knowledgeable in the art that the primary and secondary optical elements, may contain many individual optical elements that work in concert, but for now we simply refer to them as the primary and secondary optical element. The point is that the primary optical element provides the collecting aperture and the function of the secondary optical element grouping is to correct for optical aberrations and/or separate the active guidance and passive imaging radiation.

In this embodiment, a measurement subsystem 302 is positioned in the first optical path at or near an intermediate image plane 56 formed by the primary and secondary optical elements. The measurement subsystem 302 includes an optical phased array (OPA) 310 that can be switched between a least two states. The first OPA state is one in which each of the individual array elements has little or no optical power. The second OPA state controls the phase in the individual OPA array elements to create an array of optical focusing elements. These two OPA states perform two functions, the SAL (or active) measurement function and the wavefront error estimate function, in combination with the primary and secondary optical elements. The SAL measurement function is that of a typical optical system that spatially encodes the angle of incident radiation at the entrance pupil of the system formed by the primary and secondary optical elements. This function is performed when the OPA is in its first state. The transformation occurs at the image plane defined by the primary and secondary optical elements and/or any plane that is an optical conjugate of the aforementioned image plane. The SAL measurement function is a result of the standard imaging configuration that provides the ability to form a target LOS error estimate for missile guidance (i.e. photons that are traveling along rays with the same incident angle to the entrance pupil are mapped to the same spatial location at the image plane, while photons at different incident angles are mapped to different spatial locations at the image plane). The wavefront error estimate function is to spatially encode wavefront deviations emanating from sub-pupils of the exit pupil of the optical system in such a way that they do not interfere with the spatial encoding in the SAL measurement function. In this case, the photons that are located within defined sub-pupils of the entire exit pupil are spatially encoded at the image plane of the array of optical focusing elements based on the deviation of the local wavefront tilt from the desired local wavefront tilt for the imaging system defined by the primary and secondary optical elements. This function is performed when the OPA is in its second state.

An active imaging detector 306 is positioned at the image plane of the array of optical focusing elements to convert the spatially encoded active guidance radiation into an electrical signal. The active imaging detector 306 has significantly more resolution than what is typical in a standard SAL EO Sensor. While the number of pixels is a system design consideration and could consist of any number of pixels, a standard CCD device in the megapixel class is sufficient, while the typical SAL system usually employs a detector with four pixels in a quad-cell photodiode configuration.

A processor (or processors) 308 processes the electrical signal in accordance with the respective spatial encodings to generate at least one active guidance signal 68 and a wavefront error estimate for the primary optical element. The processor utilizes a priori information about the spatial encodings provided by the combination of the array of optical focusing elements and the primary/secondary optical elements to extract the desired electrical signals for processing of the SAL image measurement data as well as the wavefront error estimation data. These mappings are provided by the two functions of the array of optical focusing elements as discussed above. The processor then determines the LOS error to the target for the SAL guidance signal from the encoded SAL image measurement data. As required, the processor will utilize the encoding performed by the array of optical focusing elements to provide a wavefront error estimate that can be used to generate an actuator control signal 70 to form a control loop for the actuators 52 on the deformable primary optical element 46 via the wavefront error estimation data. The actuators on the primary optical element will deform the optical element via the control signal in an effort to provide the desired imaging performance in both the Semi-Active Laser and passive imaging modes of the dual mode EO sensor. Alternatively, the wavefront error estimate can be used to update knowledge of the current wavefront error, which might be used in a variety of ways to improve algorithmic performance without the use of a closed-loop adaptive optical system.

The optical function for wavefront error estimation is to map sub-pupil locations of the system pupil to the detector. This can be accomplished in a few different ways. One method is via a plenoptic configuration of lenslets at or near the focal plane of the telescope as discussed in the first embodiment. In the currently discussed embodiment, the plenoptic configuration is created by controlling the phase of the individual array elements in the OPA, such that an array of optical focusing elements is formed. This parallel approach measures the wavefront error across the exit pupil simultaneously as opposed to the method involving the SLM, which performs a sub-pupil trace and measures each sub-pupil sequentially. This embodiment then serves as a hybrid between the first two embodiments. In this case the spatial resolution of the active guidance signal is not impacted. While the wavefront estimate is performed in series with the active guidance signal, the wavefront error estimate itself is made in parallel, making it less susceptible to temporal fluctuations.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A dual-mode sensor, comprising:

a primary optical element having a common aperture for collecting and focusing active guidance radiation and passive imaging radiation along a common optical path;

a secondary optical element in the common optical path, said secondary optical element separating the active guidance and passive imaging radiation and directing the active guidance radiation along a first optical path and directing the passive imaging radiation along a second optical path, said primary and secondary optical elements defining an entrance pupil and an exit pupil in the first optical path;

a passive imaging radiation detector in the second optical path that detects focused passive imaging radiation to generate at least one passive imaging guidance signal; and an active guidance radiation measurement subsystem in the first optical path at or near an intermediate image plane formed by the primary and secondary optical elements, said active guidance radiation measurement subsystem comprising:

an array of optical focusing elements, said array spatially encoding an angle of incidence of the active guidance radiation incident at said entrance pupil and spatially encoding wavefront tilt deviations emanating from sub-pupils of said exit pupil onto the active guidance radiation at an image plane of the array of optical focusing elements;

an active imaging detector at the image plane of the array of optical focusing elements that converts the spatially encoded active guidance radiation into an electrical signal; and a processor that processes the electrical signal in accordance with the respective spatial encodings to generate at least one active guidance signal and a wave front error estimate for the primary optical element.

2. The dual-mode sensor of claim 1, wherein said active guidance radiation comprises laser radiation from a semi-active laser (SAL) designator reflected off of the target and the passive imaging radiation comprises infrared (IR) radiation emitted from or reflected off of the target.

3. The dual-mode sensor of claim 1, wherein the measurement subsystem generates the wavefront error estimate without impacting an update rate of the active guidance signal.

4. The dual-mode sensor of claim 1, wherein the primary optical element is deformable, further comprising a plurality of actuators placed on the primary optical element, said processor generating actuator control signals responsive to the wavefront error estimate, said actuators responsive to the actuator control signals to deform the primary optical element.

5. The dual-mode sensor of claim 4, wherein said dual-mode sensor is mounted on an guided munition, wherein said wavefront error estimate is measured and said actuators actuated to deform the primary optical element only once prior to launch of the guided munition.

6. The dual-mode sensor of claim 4, wherein said dual-mode sensor is mounted on an guided munition, wherein said wavefront error estimate is measured and said actuators actuated to deform the primary optical element prior to launch of the guided munition and at least once after launch.

7. The dual-mode sensor of claim 1, wherein said processor generates the wavefront error estimate as an output.

8. The dual-mode sensor of claim 1, wherein said processor uses the wavefront error estimate to improve an estimate of target position.

9. The dual-mode sensor of claim 1, wherein said array of optical focusing elements comprises a lenslet array positioned at or near the intermediate image plane so that at least two lenslets are illuminated along each axis of the array to perform the two spatial encodings simultaneously in parallel, said processor summing the electrical signals from detector pixels behind each lenslet, combining the summations from each lenslet into an active image with a spatial resolution defined by the lenslet array, and determining a position of a target in the active image to generate the active guidance signal, said processor computing a wavefront error estimate from individual detector pixels behind each lenslet that are mapped optically to the same sub-pupil, integrating the estimates from each said sub-pupil across said exit pupil to obtain an active wavefront error estimate, and removing known wavefront mots due to the second optical component to provide the wavefront error estimate of the primary optical component.

10. The dual-mode sensor of claim 9, wherein said processor computes a center of mass from individual detector pixels behind each lenslet that are mapped optically to the same sub-pupil to provide the wavefront error estimate for each said sub-pupil.

11. The dual-mode sensor of claim 9, wherein said lenslet array comprises M×M lenslets, there are N×N detector pixels behind each lenslet and N×N sub-pupils and N*M×N*M detector pixels in the active imaging detector, wherein the spatial resolution of the active image is traded against the spatial resolution N×N of the wavefront error estimate according to the number M×M of lenslets in the array.

12. The dual-mode sensor of claim 9, wherein the lenslet array is positioned near but not at the intermediate image array.

13. The dual-mode sensor of claim 9, wherein the lenslet array is positioned at the intermediate image array, further comprising a diffuser positioned upstream of the lenslet array so that at least two lenslets are illuminated along each axis of the array.

14. The dual-mode sensor of claim 1, wherein the array of optical focusing elements comprises:

an optical relay that defines a collimated space with a relayed exit pupil, said optical relay including a collimating optic positioned with its focal plane at or near the intermediate image plane and a focusing optical element positioned with its rear focal plane at or near the plane of said active imaging detector; and a spatial light modulator, positioned in the collimated space, comprising an array of optical elements that are switchable to control transmission through said optical elements to perform the two spatial encodes time sequentially, said array switchable between a first state in which the optical elements are activated with a first spatial pattern to spatially encode the angle of incidence in an active image onto the active imaging detector and a second state in which the optical elements are activated to trace a single sub-pupil region in as second spatial pattern over the relayed exit pupil to spatially encode the wavefront tilt deviations in a temporal sequence of sub-pupils that are imaged one sub-pupil at as time onto the active imaging detector, wherein the processor determines a position of a target in the active image in the first state to generate the active guidance signal, and wherein the processor computes an estimate of the wavefront tilt for each sub-pupil traced in the second state, integrates the estimates over the relayed exit pupil to provide an active wavefront error estimate and removes known wavefront errors due to the second optical component to provide the wavefront error estimate of the primary optical component.

15. The dual-mode sensor of claim 14, wherein for a given active imaging detector said switchable array provides a maximum spatial resolution for the active image and a maximum spatial resolution for the wavefront error estimate without impacting the SNR or an update rate of the active image.

16. The dual-mode sensor of claim 14, wherein imaging one sub-pupil at a time onto the active imaging detector provides a maximum dynamic range for measurement of the wavefront tilt deviation for the given active imaging detector.

17. The dual-mode sensor of claim 1, wherein said array of optical focusing elements comprises an optical phased array positioned at or near the intermediate image plane so that at least two elements in the optical phased array are illuminated along each axis of the may to perform the two spatial encodings simultaneously in parallel, said optical phased array comprising an array of optical elements that are switchable to control the optical powers of each element individually to perform the two spatial encodes time sequentially, said array switchable between a first state in which the optical elements are activated in a manner such that they act as a plane parallel plate across the exit pupil to spatially encode the angle of incidence in an active image onto the active imaging detector and a second state in which the individual optical elements are activated to create an array of optical focusing elements in a second spatial pattern over the relayed exit pupil to spatially encode the wavefront tilt deviations across the exit pupil in parallel onto the active imaging detector, wherein the processor determines a position of a target in the active image in the first state to generate the active guidance signal, and wherein the processor computes a wavefront error estimate from individual detector pixels behind each element in the optical phased array in the second state that are mapped optically to the same sub-pupil, integrating the estimates from each said sub-pupil across said exit pupil to obtain an active wavefront error estimate, and removing known wavefront errors due to the second optical component to provide the wavefront error estimate of the primary optical component.

18. A dual-mode sensor, comprising:

a primary optical element having a common aperture for collecting and focusing active guidance radiation and passive imaging radiation along a common optical path;

a secondary optical element in the common optical path, said secondary optical element separating the active guidance and passive imaging radiation and directing the active guidance radiation along a first optical path and directing the passive imaging radiation along a second optical path, said primary and secondary optical elements defining an entrance pupil and an exit pupil in the first optical path;

a passive imaging radiation detector in the second optical path that detects focused passive imaging radiation to generate at least one passive imaging guidance signal; and an active guidance radiation measurement subsystem comprising:

a lenslet array positioned at or near an intermediate image plane formed in the first optical path by the primary and secondary optical elements so that at least two lenslets are illuminated along each axis of the array, said array simultaneously and in parallel spatially encoding an angle of incidence of the active guidance radiation incident at said entrance pupil and spatially encoding wavefront tilt deviations emanating from sub-pupils of said exit pupil onto the active guidance radiation at an image plane of the lenslet array;

an active imaging detector at the image plane of the array of optical focusing elements that converts the spatially encoded active guidance radiation into an electrical signal; and a processor that sums the electrical signals from detector pixels behind each lenslet, combines the summations from each lenslet into an active image with a spatial resolution defined by the lenslet array, and determines as position of a target in the active image to generate an active guidance signal, said processor computes as wavefront error estimate from individual detector pixels behind each lenslet that are mapped optically to the same sub-pupil, integrates the estimates from each said sub-pupil across said exit pupil to obtain an active wavefront error estimate, and removes known wavefront errors due to the second optical component to provide the wavefront error estimate of the primary optical component.

19. The dual-mode sensor of claim 18, wherein said lenslet array comprises M×M lenslets, there are N×N detector pixels behind each lenslet and N×N sub-pupils and N*M×N*M detector pixels in the active imaging detector, wherein the spatial resolution of the active image is traded against the spatial resolution N×N of the wavefront error estimate according to the number M×M of lenslets in the array.

20. A dual-mode sensor, comprising:

a primary optical element having a common aperture for collecting and focusing active guidance radiation and passive imaging radiation along a common optical path;

a secondary optical element in the common optical path, said secondary optical element separating the active guidance and passive imaging radiation and directing the active guidance radiation along a first optical path and directing the passive imaging radiation along a second optical path, said primary and secondary optical elements defining an entrance pupil and an exit pupil in the first optical path;

a passive imaging radiation detector in the second optical path that detects focused passive imaging radiation to generate at least one passive imaging guidance signal; and an active guidance radiation measurement subsystem in the first optical path at or near an intermediate image plane formed by the primary and secondary optical elements, said active guidance radiation measurement subsystem comprising:

an optical relay that defines a collimated space with a relayed exit pupil, said optical relay including a collimating optic positioned with its focal plane coincident with the intermediate image plane and a focusing optical element positioned with its rear focal plane coincident with the image plane and said active imaging detector;

an array of optical elements, positioned in said collimated space, switchable to control transmission through said optical element to perform two spatial encodings time sequentially, said array switchable between a first state in which the optical elements are activated with a first spatial pattern to spatially encode an angle of incidence of the active guidance radiation incident at said entrance pupil in an active image at an image plane of the array of optical elements and a second state in which the optical elements are activated to trace a simile sub-pupil region in a second spatial pattern over the relayed exit pupil to spatially encode wavefront tilt deviations emanating from sub-pupils of said relayed exit pupil in a temporal sequence of sub-pupils that are imaged one sub-pupil at a time onto the image plane of the array of optical focusing elements;

an active imaging detector at the image plane of the array of optical focusing elements that converts the spatially encoded active guidance radiation into an electrical signal; and a processor that processes the electrical signal to determine a position of a target in the active image in the first state to generate an active guidance signal and computes an estimate of the wavefront tilt for each sub-pupil traced in the second state, integrates the estimates over the relayed exit pupil to provide an active wavefront error estimate and removes known wavefront errors due to the second optical component to provide a wavefront error estimate of the primary optical component.

21. The dual-mode sensor of claim 20, wherein for a given active imaging detector said switchable array provides a maximum spatial resolution for the active image and a maximum spatial resolution for the wavefront error estimate with impacting the SNR or an update rate of the active image.

22. The dual-mode sensor of claim 20, wherein imaging one sub-pupil at a time onto the active imaging detector provides a maximum dynamic range for measurement of the wavefront tilt deviation for the given active imaging detector.

23. A method of wavefront error estimation for a guided munition, comprising:

illuminating a target with laser radiation from a semi-active laser (SAL) designator; and on-board the guided munition, collecting and focusing SAL laser radiation reflected off of the target and passive imaging radiation for the target with a primary optical element;

spectrally separating the SAL laser radiation and the passive imaging radiation with a secondary optical element, said primary and secondary optical elements defining an entrance pupil and an exit pupil;

detecting the passive imaging radiation to generate a passive imaging guidance signal;

spatially encoding an angle of incidence of the SAL laser radiation incident at said entrance pupil onto the SAL laser radiation;

spatially encoding wavefront tilt deviations emanating from sub-pupils of said exit pupil onto the SAL laser radiation;

detecting the spatially encoded SAL laser radiation to generate an electrical signal; and processing the electrical signal in accordance with the respective spatial encodings to generate at least one SAL guidance signal and a wavefront error estimate for the primary optical element.

* * * * *

UNITED STATES PATENT AND TRADEMARK OFFICE

CERTIFICATE OF CORRECTION

PATENT NO. : 8,502,128 B1
APPLICATION NO. : 13/621047
DATED : August 6, 2013
INVENTOR(S) : Casey T. Streuber It is certified that error appears in the above-identified patent and that said Letters Patent is hereby corrected as shown below:

In the Claims:

In column 20, claim 20, line 38, delete "simile" and insert --single--.

Signed and Sealed this
Seventeenth Day of September, 2013

Teresa Stanek Rea
*Deputy Director of the United States Patent and Trademark Office*